US010763578B2

(12) United States Patent
White et al.

(10) Patent No.: US 10,763,578 B2
(45) Date of Patent: Sep. 1, 2020

(54) DUAL BAND MULTIPLE-INPUT MULTIPLE-OUTPUT ANTENNAS

(71) Applicant: Laird Technologies, Inc., Chesterfield, MO (US)

(72) Inventors: Jonathan Cleston Harris White, Stow, OH (US); William Steinike, Cedarburg, WI (US); Brian E. Petted, Cedarburg, WI (US); Kean Meng Lim, Kedah (MY); Chit Yong Hang, Penang (MY)

(73) Assignee: LAIRD CONNECTIVITY, INC., Akron, OH (US)

( * ) Notice: Subject to any disclaimer, the term of this patent is extended or adjusted under 35 U.S.C. 154(b) by 0 days.

(21) Appl. No.: 16/112,021

(22) Filed: Aug. 24, 2018

(65) Prior Publication Data

US 2020/0021020 A1 Jan. 16, 2020

Related U.S. Application Data

(60) Provisional application No. 62/698,575, filed on Jul. 16, 2018.

(51) Int. Cl.

| | |
|---|---|
| ***H01Q 1/52*** | (2006.01) |
| ***H01Q 1/38*** | (2006.01) |
| ***H01Q 21/06*** | (2006.01) |
| ***H01Q 21/30*** | (2006.01) |
| ***H01Q 9/04*** | (2006.01) |

(52) U.S. Cl.

CPC ..... *H01Q 1/523* (2013.01); *H01Q 1/38* (2013.01); *H01Q 9/0421* (2013.01); *H01Q 21/065* (2013.01); *H01Q 21/30* (2013.01)

(58) Field of Classification Search

CPC .... H01Q 1/523; H01Q 21/065; H01Q 9/0421; H01Q 21/30; H01Q 1/38; H01Q 5/307; H01Q 1/48; H01Q 21/28

See application file for complete search history.

(56) References Cited

U.S. PATENT DOCUMENTS

| | | | | |
|---|---|---|---|---|
| D683,720 | S | 6/2013 | Quinlan et al. | |
| 8,779,988 | B2 | 7/2014 | Yang et al. | |
| 8,810,457 | B2 | 8/2014 | Flores-Cuadras et al. | |
| 9,472,852 | B2 | 10/2016 | O'Shea et al. | |
| 2008/0198082 | A1* | 8/2008 | Soler Castany | H01Q 1/38 343/770 |
| 2009/0009400 | A1* | 1/2009 | Kim | H01Q 1/521 343/700 MS |

(Continued)

OTHER PUBLICATIONS

FXUB71 Wide Band Flex 2xMIMO 150mm Ø1.37, http://www.taoglas.com, Copyright 2017, 4 pages.

*Primary Examiner* — Dimary S Lopez Cruz
*Assistant Examiner* — Michael M Bouizza
(74) *Attorney, Agent, or Firm* — Harness, Dickey & Pierce, P.L.C.; Anthony G. Fussner

(57) ABSTRACT

Exemplary embodiments are disclosed of dual-band multiple-input multiple-output (MIMO) antennas. In an exemplary embodiment, an antenna generally includes a circuit board, a first antenna radiating element positioned on the circuit board, a second antenna radiating element positioned on the circuit board, and at least two antenna feeding elements extending from the circuit board. Each of the at least two antenna feeding elements is electrically connected with a different one of the first and second antenna elements.

18 Claims, 20 Drawing Sheets

(56) References Cited

U.S. PATENT DOCUMENTS

| | | | | |
|---|---|---|---|---|
| 2011/0175792 | A1* | 7/2011 | Yoon | H01Q 21/28 343/893 |
| 2013/0229318 | A1* | 9/2013 | Ng | H01Q 5/30 343/770 |
| 2015/0288059 | A1 | 10/2015 | Zuniga | |
| 2017/0047651 | A1 | 2/2017 | Zuniga | |
| 2017/0133767 | A1 | 5/2017 | Dorsey | |
| 2017/0207537 | A1 | 7/2017 | Saldivar Morales | |
| 2018/0342784 | A1* | 11/2018 | Samardzija | H01Q 1/38 |
| 2019/0267710 | A1* | 8/2019 | Jenwatanavet | H01Q 9/0407 |

* cited by examiner

| | With Isolator | | | |
|---|---|---|---|---|
| | On PC | | | On Metal |
| Specification | Separate Ground (1) | Separate Ground (2) | Same Ground | Same Ground |
| Frequency Band (MHz) | 2400-2480MHz<br>4900-5900MHz | 2400-2480MHz<br>4900-5900MHz | 2400-2480MHz<br>4900-5900MHz | 2400-2480MHz<br>4900-5900MHz |
| Gain (dBi) | 2400-2480MHz: < 3.4<br>4900-5900MHz: < 3.3 | 2400-2480MHz: < 2.5<br>4900-5900MHz: < 3.7 | 2400-2480MHz: < 2.8<br>4900-5900MHz: < 3.4 | 2400-2480MHz: < 1.7<br>4900-5900MHz: < 5.1 |
| Total Efficiency (%) | 2400-2480MHz: > 65%<br>4900-5900MHz: > 60% | 2400-2480MHz: > 64%<br>4900-5900MHz: > 53% | 2400-2480MHz: > 63%<br>4900-5900MHz: > 54% | 2400-2480MHz: > 32%<br>4900-5900MHz: > 40% |
| VSWR Max. | 2400-2480MHz: < 2.0 : 1<br>4900-5900MHz: < 2.5 : 1 | 2400-2480MHz: < 2.3 : 1<br>4900-5900MHz: < 3.0 : 1 | 2400-2480MHz: < 2.4 : 1<br>4900-5900MHz: < 2.7 : 1 | 2400-2480MHz: < 2.5 : 1<br>4900-5900MHz: < 3.0 : 1 |
| Port-to-Port Isolation (dB) | 2400-2480MHz: > 18<br>4900-5900MHz: > 20 | 2400-2480MHz: > 22<br>4900-5900MHz: > 23 | 2400-2480MHz: > 24<br>4900-5900MHz: > 21 | 2400-2480MHz: > 16<br>4900-5900MHz: > 18 |
| Envelope Correlation Coefficient (ECC) | 0.06 | 0.13 | 0.11 | 0.13 |
| Norminal Impedance, Ω | 50Ω | 50Ω | 50Ω | 50Ω |
| Polarization | Linear, Vertical | Linear, Vertical | Linear, Vertical | Linear, Vertical |
| Azimuth Beam Width | Omni-directional | Omni-directional | Omni-directional | Omni-directional |
| Dimension (mm) (W x L x H) | 34 x 32 x 4 mm approximately | 33.25 x 33.25 x 4 mm | 33.25 x 33.25 x 4 mm | 33.25 x 33.25 x 4 mm |
| Connectors | MHF1 | MHF1 | MHF1 | MHF1 |
| Cable Length, mm | 100 | 100 | 100 | 100 |
| Antenna Structure (Side View) | Flex PIFA Radiator<br>Separate Ground | Flex PIFA Radiator<br>Separate Ground | Flex PIFA Radiator<br>Same Ground | Flex PIFA Radiator<br>Same Ground |

* Antenna measured on 4" x 4" on PC/Metal material

FIG. 13A

FIG. 13B

| | Frequency | With Isolator | | | | | | | |
|---|---|---|---|---|---|---|---|---|---|
| | | On PG | | | | | | On Metal | |
| | | Actual Ground (1) | | Simulated Ground (2) | | Short Ground | | Other Ground | |
| | | Port 1 | Port 2 | Port 1 | Port 2 | Port 1 | Port 2 | Port 1 | Port 2 |
| Max Gain (dBi) | 2400 MHz | 2.82 | 1.58 | 2.32 | 1.59 | 2.09 | 2.56 | 0.66 | 1.02 |
| | 2410 MHz | 3.18 | 1.70 | 2.46 | 1.59 | 2.26 | 2.69 | 0.98 | 1.02 |
| | 2420 MHz | 3.38 | 1.58 | 2.44 | 1.66 | 2.48 | 2.74 | 1.09 | 1.14 |
| | 2430 MHz | 3.41 | 1.32 | 2.31 | 1.81 | 2.43 | 2.83 | 1.05 | 1.48 |
| | 2440 MHz | 3.13 | 1.07 | 2.25 | 1.77 | 2.25 | 2.69 | 1.04 | 1.53 |
| | 2450 MHz | 2.85 | 1.07 | 2.24 | 1.82 | 2.13 | 2.65 | 0.92 | 1.60 |
| | 2460 MHz | 2.84 | 1.08 | 2.32 | 1.98 | 2.05 | 2.81 | 1.00 | 1.65 |
| | 2470 MHz | 2.91 | 1.14 | 2.34 | 1.92 | 1.95 | 2.71 | 0.99 | 1.58 |
| | 2480 MHz | 3.10 | 1.29 | 2.31 | 1.96 | 2.04 | 2.72 | 1.04 | 1.47 |
| | 4900 MHz | 2.76 | 3.02 | 1.22 | 1.68 | 2.45 | 0.88 | 2.87 | 3.39 |
| | 4950 MHz | 2.46 | 2.86 | 1.35 | 1.86 | 2.45 | 1.34 | 2.96 | 3.37 |
| | 5000 MHz | 2.30 | 2.48 | 1.60 | 1.52 | 2.61 | 1.17 | 3.62 | 3.41 |
| | 5050 MHz | 2.06 | 2.78 | 1.59 | 1.52 | 2.30 | 1.42 | 3.74 | 3.41 |
| | 5100 MHz | 2.06 | 2.42 | 1.72 | 1.56 | 2.13 | 1.86 | 3.36 | 3.25 |
| | 5150 MHz | 2.36 | 2.39 | 2.26 | 1.92 | 2.43 | 1.95 | 3.70 | 3.22 |
| | 5200 MHz | 2.50 | 2.50 | 2.35 | 2.16 | 2.65 | 2.29 | 3.73 | 3.52 |
| | 5250 MHz | 2.65 | 2.53 | 2.40 | 2.14 | 2.41 | 2.27 | 3.78 | 3.70 |
| | 5300 MHz | 2.65 | 2.63 | 2.48 | 2.22 | 2.15 | 2.17 | 3.95 | 3.57 |
| | 5350 MHz | 2.95 | 2.83 | 3.15 | 2.54 | 2.29 | 2.23 | 3.74 | 3.26 |
| | 5400 MHz | 2.82 | 3.02 | 3.10 | 2.83 | 2.49 | 2.65 | 3.98 | 3.79 |
| | 5450 MHz | 2.93 | 3.03 | 3.27 | 2.80 | 2.45 | 2.56 | 3.91 | 3.21 |
| | 5500 MHz | 3.13 | 3.12 | 3.21 | 2.65 | 2.15 | 2.30 | 3.07 | 2.53 |
| | 5550 MHz | 2.94 | 3.13 | 3.51 | 2.89 | 2.65 | 2.69 | 3.05 | 2.60 |
| | 5600 MHz | 3.07 | 3.26 | 3.68 | 3.03 | 3.12 | 3.18 | 2.99 | 2.93 |
| | 5650 MHz | 3.02 | 2.97 | 3.62 | 2.95 | 3.12 | 3.03 | 2.94 | 2.94 |
| | 5700 MHz | 2.95 | 3.13 | 3.61 | 2.82 | 3.38 | 3.09 | 3.64 | 3.27 |
| | 5750 MHz | 2.87 | 2.94 | 3.26 | 2.63 | 3.19 | 3.00 | 3.91 | 3.25 |
| | 5800 MHz | 2.73 | 2.61 | 3.22 | 2.08 | 3.13 | 2.66 | 4.32 | 3.26 |
| | 5850 MHz | 2.81 | 2.73 | 2.76 | 2.08 | 3.24 | 2.51 | 5.09 | 3.55 |
| | 5900 MHz | 2.72 | 2.44 | 2.55 | 1.48 | 3.26 | 2.18 | 4.94 | 3.14 |
| | 2400-2480 MHz | 3.41 | 1.70 | 2.46 | 1.98 | 2.48 | 2.83 | 1.09 | 1.65 |
| | 4900-5900 MHz | 3.13 | 3.26 | 3.68 | 3.03 | 3.38 | 3.18 | 5.09 | 3.79 |

FIG. 13C

| | | With Isolator | | | | | | | |
|---|---|---|---|---|---|---|---|---|---|
| | | On PCB | | | | | | On Metal | |
| | Frequency | Separate Ground (1) | | Separate Ground (2) | | Same Ground | | Same Ground | |
| | | Port 1 | Port 2 | Port 1 | Port 2 | Port 1 | Port 2 | Port 1 | Port 2 |
| Efficiency (%) | 2400 MHz | 68.4 | 65.0 | 64.0 | 68.6 | 62.6 | 67.8 | 31.3 | 30.2 |
| | 2410 MHz | 69.8 | 65.9 | 64.1 | 67.3 | 62.9 | 66.8 | 32.9 | 31.3 |
| | 2420 MHz | 72.0 | 65.4 | 64.5 | 66.3 | 63.8 | 65.9 | 33.5 | 32.2 |
| | 2430 MHz | 73.3 | 66.5 | 63.9 | 66.8 | 63.2 | 66.5 | 33.8 | 33.8 |
| | 2440 MHz | 73.5 | 66.6 | 62.8 | 65.0 | 62.0 | 64.8 | 33.4 | 34.1 |
| | 2450 MHz | 72.0 | 66.3 | 63.0 | 64.7 | 61.8 | 64.8 | 32.7 | 34.1 |
| | 2460 MHz | 71.4 | 66.4 | 63.9 | 65.3 | 62.5 | 65.2 | 32.6 | 34.4 |
| | 2470 MHz | 70.8 | 66.5 | 63.5 | 64.3 | 62.2 | 64.3 | 31.6 | 33.6 |
| | 2480 MHz | 69.6 | 67.9 | 63.5 | 64.1 | 62.2 | 64.0 | 31.0 | 33.1 |
| | 4900 MHz | 58.7 | 56.2 | 40.9 | 41.2 | 54.3 | 43.9 | 43.4 | 50.2 |
| | 4950 MHz | 55.5 | 52.4 | 41.4 | 43.0 | 53.0 | 44.5 | 45.1 | 47.5 |
| | 5000 MHz | 56.8 | 53.1 | 41.8 | 44.1 | 52.3 | 44.7 | 48.0 | 45.8 |
| | 5050 MHz | 59.5 | 55.0 | 42.5 | 44.9 | 52.1 | 45.1 | 50.5 | 44.2 |
| | 5100 MHz | 56.9 | 54.5 | 42.7 | 46.1 | 50.7 | 46.1 | 46.1 | 39.6 |
| | 5150 MHz | 60.3 | 56.2 | 48.0 | 50.6 | 55.7 | 50.9 | 45.6 | 39.4 |
| | 5200 MHz | 60.9 | 57.0 | 50.8 | 52.7 | 56.2 | 53.1 | 47.1 | 40.8 |
| | 5250 MHz | 61.0 | 59.1 | 50.9 | 53.9 | 53.6 | 52.5 | 46.7 | 40.9 |
| | 5300 MHz | 63.7 | 63.1 | 52.7 | 55.6 | 53.1 | 52.3 | 45.9 | 39.0 |
| | 5350 MHz | 64.7 | 63.3 | 55.1 | 57.2 | 53.6 | 52.1 | 43.6 | 36.3 |
| | 5400 MHz | 66.3 | 68.4 | 59.1 | 63.1 | 56.5 | 57.6 | 44.4 | 38.2 |
| | 5450 MHz | 65.0 | 67.3 | 58.2 | 61.8 | 55.1 | 56.5 | 42.8 | 35.9 |
| | 5500 MHz | 65.2 | 68.6 | 58.0 | 60.1 | 53.5 | 54.0 | 41.2 | 33.6 |
| | 5550 MHz | 64.6 | 69.4 | 59.4 | 63.2 | 54.6 | 57.1 | 38.4 | 33.0 |
| | 5600 MHz | 66.4 | 70.8 | 64.1 | 66.6 | 59.8 | 62.8 | 41.5 | 36.9 |
| | 5650 MHz | 64.3 | 68.9 | 64.7 | 64.5 | 62.6 | 63.3 | 42.8 | 38.0 |
| | 5700 MHz | 62.3 | 68.2 | 63.9 | 63.8 | 64.3 | 64.1 | 46.1 | 41.0 |
| | 5750 MHz | 61.7 | 66.3 | 61.6 | 61.2 | 63.4 | 62.4 | 46.7 | 42.7 |
| | 5800 MHz | 59.4 | 63.0 | 57.2 | 57.2 | 60.7 | 59.0 | 47.2 | 44.2 |
| | 5850 MHz | 59.0 | 61.7 | 54.4 | 54.3 | 61.1 | 57.2 | 52.2 | 46.7 |
| | 5900 MHz | 55.2 | 55.9 | 47.8 | 48.3 | 56.4 | 51.1 | 47.5 | 42.1 |
| | 2400-2480 MHz | 71.2 | 66.3 | 63.7 | 65.8 | 62.6 | 65.6 | 32.5 | 33.0 |
| | 4900-5900 MHz | 61.3 | 61.8 | 53.1 | 54.9 | 56.3 | 53.8 | 45.4 | 40.8 |

DUAL BAND MULTIPLE-INPUT MULTIPLE-OUTPUT ANTENNAS

CROSS-REFERENCE TO RELATED APPLICATION

This application claims priority to and the benefit of U.S. Provisional Patent Application No. 62/698,575 filed Jul. 16, 2018. The entire disclosure of the above application is incorporated herein by reference.

FIELD

The present disclosure generally relates to dual-band multiple-input multiple-output antennas.

BACKGROUND

This section provides background information related to the present disclosure which is not necessarily prior art.

Multiple-input multiple-output (MIMO) radios typically require two or more separately mounted antennas for optimal MIMO performance. However, mounting two separate internal/embedded antennas in a single enclosure can create issues with correct isolation, polarization, and tuning. Also, many devices in which MIMO radios are desirable may not have the necessary footprint size to accept two separate internal/embedded antennas.

When designing MIMO antennas with smaller profiles, improved isolation (e.g., >15 decibels (dB), etc.) and efficiency across all operating frequency bands, challenges arise for planar inverted-F antennas with quarter-wave designs. In some cases, ground proximity coupling has been applied to flexible planar inverted-F antennas (PIFAs) to achieve improved isolation for a dual band antenna while maintaining total efficiency and max gain.

Separately, a planar inverted-F antenna generally can include a planar radiator or upper radiating patch element having a slot. A lower surface of the PIFA is spaced apart from the upper radiating patch element. First and second shorting elements electrically connect the planar radiator to the lower surface. The PIFA also includes a feeding element electrically connected between the upper radiating patch element and the lower surface. The PIFA may be mounted on a ground plane that is larger than the lower surface of the PIFA.

DRAWINGS

The drawings described herein are for illustrative purposes only of selected embodiments and not all possible implementations, and are not intended to limit the scope of the present disclosure.

FIGS. 13A-13C illustrate performance summary data measured for a prototype of the antennas of FIGS. 9A, 9B and 10 with different positions and types of ground elements;

Corresponding reference numerals indicate corresponding parts throughout the several views of the drawings.

DETAILED DESCRIPTION

Figure 2:
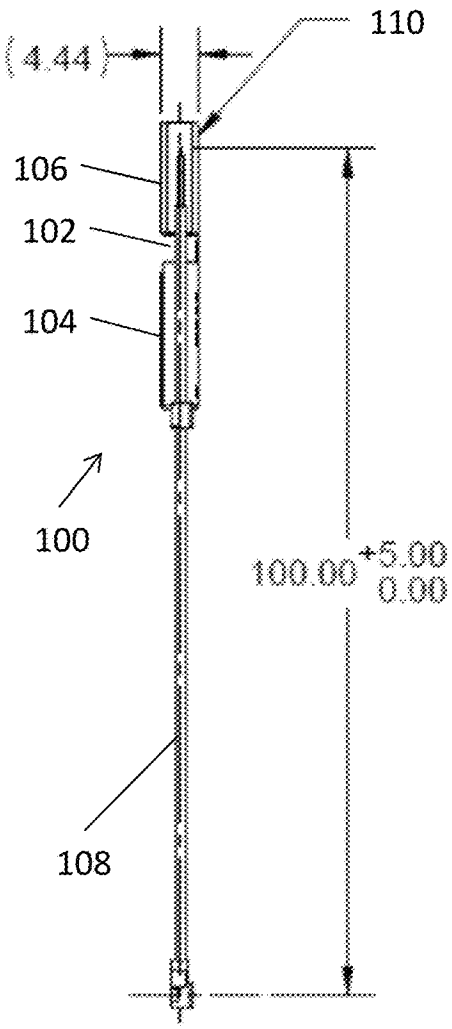
FIG. 2 is a side view of the MIMO antenna of FIG. 1.

Example embodiments will now be described more fully with reference to the accompanying drawings.

Disclosed herein are example embodiments of dual-band multiple-input multiple-output antennas. In some embodiments, a dual-band multiple-input multiple-output antenna includes two stacked antennas in a single package with two antenna leads coming off of the MIMO antenna. The antenna can be optimized and tuned for 2×2 MIMO operations in an embedded device. For example, tuning, isolation, polarization, etc. can be optimized for MIMO operations.

A dual-band multiple-input multiple-output antenna may include an adhesive (e.g., adhesive backing, liner, etc.) positioned on a side of the antenna, to simplify mounting of the MIMO antenna to a surface. This can greatly reduce complexity when integrating a MIMO device.

In some embodiments, a wireless local area network (WLAN) dual-band MIMO antenna can operate in a frequency range of about 2.4-2.48 GHz, and a frequency range of about 4.9-5.9 GHz. The antenna may include two radiating elements (e.g., planar inverted-F antenna (PIFA) elements, etc.) and a ground element (e.g., layer, isolator, plane, etc.).

The two radiating elements may be arranged, positioned, located, etc. at a top layer of the MIMO antenna. The ground element is optionally located at a top or bottom layer of the MIMO antenna. For example, a flexible printed circuit board (PCB) may include two radiating elements on a top layer (e.g., copper trace layer, etc.) of the PCB and a ground element on a bottom layer (e.g., copper trace layer, etc.) of the PCB. Alternatively, or in addition, the two radiating elements and the ground element may be located on the top layer of the PCB.

Each radiating element may include an upper planar radiator, and a lower surface electrically connected to the upper planar radiator. The ground element may optionally be positioned below the lower surface of each radiating element, above the lower surface of the radiating element, electrically connected to (e.g., integral with, etc.) the lower surface of the radiating element, etc.

The ground element may include a smaller arrow portion corresponding to a 5 GHz band, and a larger arrow portion corresponding to a 2.4 GHz band. For example, the two arrow portions may be located at opposite corners and connected to one another via a middle portion of the ground element.

The ground element may be configured (e.g., shaped, sized, etc.) to have a ¼ wavelength for the 2.4 GHz band and a ½ wavelength for the 5 GHz band, at the ground element. This ground element may substantially cancel current flow at 2.4 GHz and 5 GHz, and thus improve antenna isolation.

Two top radiating elements (e.g., PIFA elements) may be positioned at least partially over the larger arrow portion of the ground element, at an angle of about ninety degrees with respect to one another. This can improve antenna isolation and introduce different polarities for each antenna element at each frequency band.

Example embodiments may provide one or more (or none) of the following advantages: reduced complexity when mounting antennas, faster time to market for customers, a reduced footprint compared to using two separate PCB or similar antennas, improved tuning for a 2×2 MIMO antenna to reduce customer error when selecting antenna placement, improved isolation for MIMO WLAN dual-band antennas with same or separate ground elements, reduced size, improved isolation on plastic or metal surfaces, improved voltage standing wave ratios (VSWRs), etc.

Figure 1:
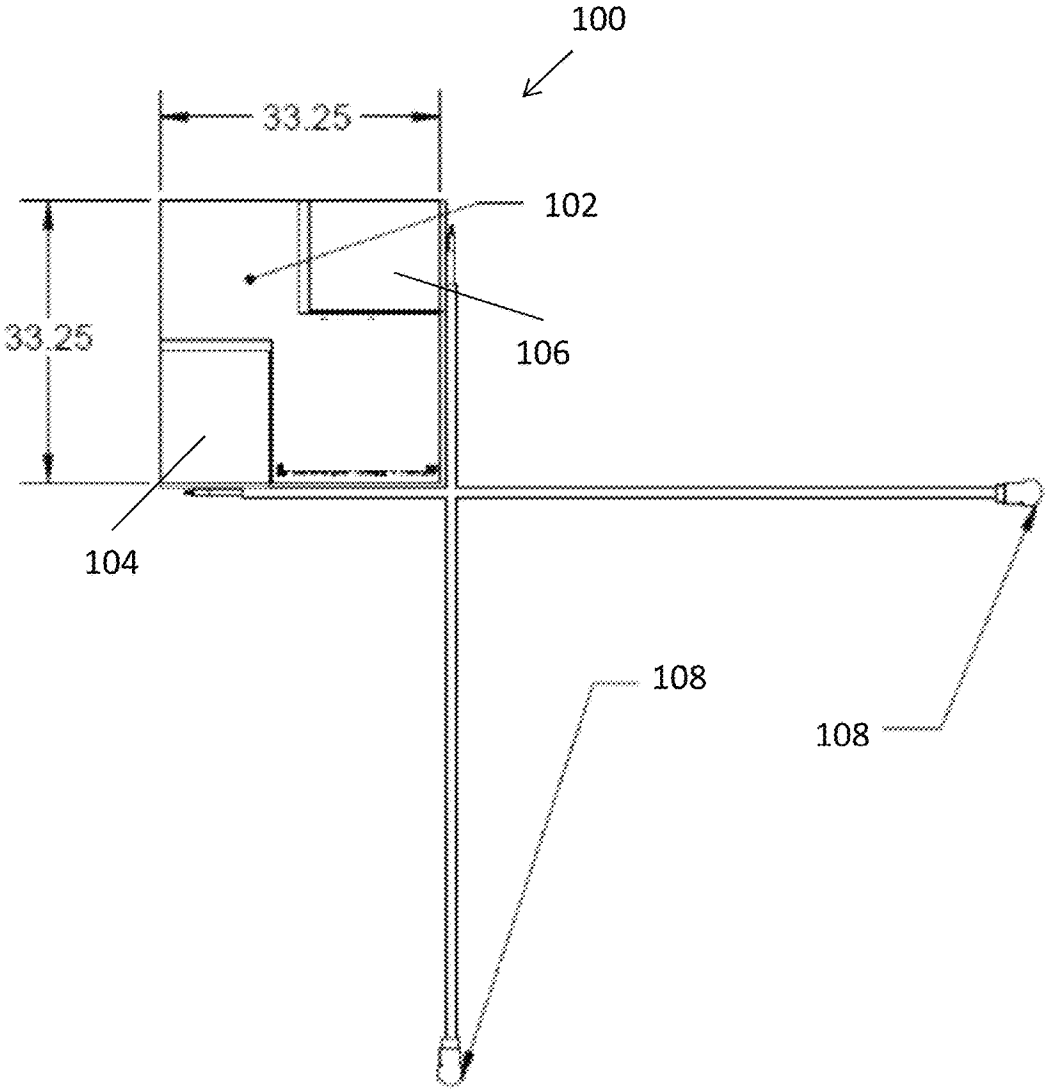
FIG. 1 is a front view of a dual-band multiple-input multiple-output (MIMO) antenna according to an exemplary embodiment.

Referring now to the Figures, FIGS. 1 and 2 illustrate a dual-band multiple-input multiple-output (MIMO) antenna 100 according to one example embodiment of the present disclosure. The antenna 100 includes a circuit board 102, a first antenna radiating element 104 positioned on the circuit board 102, and a second antenna radiating element 106 positioned on the circuit board 102.

Two antenna feeding elements 108 extend from the antenna radiating elements 104 and 106, respectively. Each of the two antenna feeding elements 108 are electrically connected with different ones of each of the first and second antenna radiating elements 104 and 106.

As shown in FIG. 1, the circuit board 102 has a rectangular shape, and the first and second antenna radiating elements 104 and 106 are positioned along different sides of the circuit board 102. Specifically, the first and second antenna radiating elements 104 and 106 are positioned at opposite corners of the circuit board 102 from one another.

The first and second antenna radiating elements 104 and 106 are each oriented at a ninety degree angle with respect to one another. This can improve antenna isolation and introduce different polarities for each antenna radiating element 104 and 106 at each frequency band (e.g., a 2.4-2.48 GHz frequency band, a frequency 4.9-5.9 GHz frequency band, etc.). Similarly, the antenna feeding elements 108 are each oriented at a ninety degree angle with respect to one another. In other embodiments, the antenna feeding elements 108 may be oriented at other angles (e.g., parallel, etc.), which may depend on a device feeding requirement.

Each antenna radiating element 104 and 106 may include any suitable radiating portion arrangement, design, layout, etc., such as a planar inverted-F antenna (PIFA) element. For example, each antenna radiating element 104 and 106 may include a planar radiator or upper radiating patch element having a slot, a lower surface spaced apart from the planar radiator or upper radiating patch element, first and second shorting elements electrically connecting the planar radiator or upper radiating patch element to the lower surface, a feeding element electrically connected between the planar radiator or upper radiating patch element and the lower surface, etc.

The circuit board 102 may be a flexible printed circuit board (PCB), and each antenna radiating element 104 and 106 may include one or more copper traces, plates, etc. positioned on a surface of the flexible printed circuit board 102.

As shown in FIG. 2, an adhesive layer 110 is positioned on a side of the circuit board 102. The adhesive layer 110 can be used to mount the antenna 100 to a surface, which can reduce complexity when mounting the antenna 100, etc.

Example dimensions in millimeters (mm) are provided in FIGS. 1 and 2 for purposes of illustration only, and other embodiments may include components with smaller and/or larger dimensions.

Immediately below is Table 1 with performance summary data measured for the antenna 100 illustrated in FIGS. 1 and 2. As shown by Table 1, the antenna 100 has good isolation, peak gain, VSWR, etc. at desired operating frequencies.

TABLE 1

Antenna Performance Characteristics

| SPECIFICATION | PERFORMANCE | |
|---|---|---|
| Frequency Bands, MHz | 2400-2480 | 4900-5900 |
| Peak Gain, dBi (Typ) | 1.7 | 2.5 |
| Peak Gain, dBi (Max) | 2.0 | 3.5 |
| VSWR Port1: (Typ) | <2.3:1 | <2.3:1 |
| VSWR Port2: (Typ) | <2.3:1 | <2.3:1 |
| Isolation, dB (Typ) | >19 | >19 |
| Max Gain +/− 30 above Horizon, dBi | NA | 2.2 |
| Maximum VSWR | <2.5:1 | <3.0:1 |
| Nominal Impedance | 50 Ω | |
| Max Power (Ambient temp of 25° C.) | 10 Watts | |
| Polarization | Linear H/V for each radiator | |
| Azimuth Beam Width | Omnidirectional | |
| Dimensions (L × W × H) | 33.25 × 33.25 × 4.44 mm | |
| Weight | 2.5 g | |
| Storage Temperature (° C.) | −40° C. to +85° C. | |
| Operational Temperature (° C.) | −30° C. to +70° C. | |
| Material Substance Compliance | RoHS Compliant | |

FIGS. 3-8 provide analysis results for the antenna 100 illustrated in FIGS. 1 and 2. These analysis results shown in FIGS. 3-8 are provided only for purposes of illustration and not for purposes of limitation.

Figure 3:
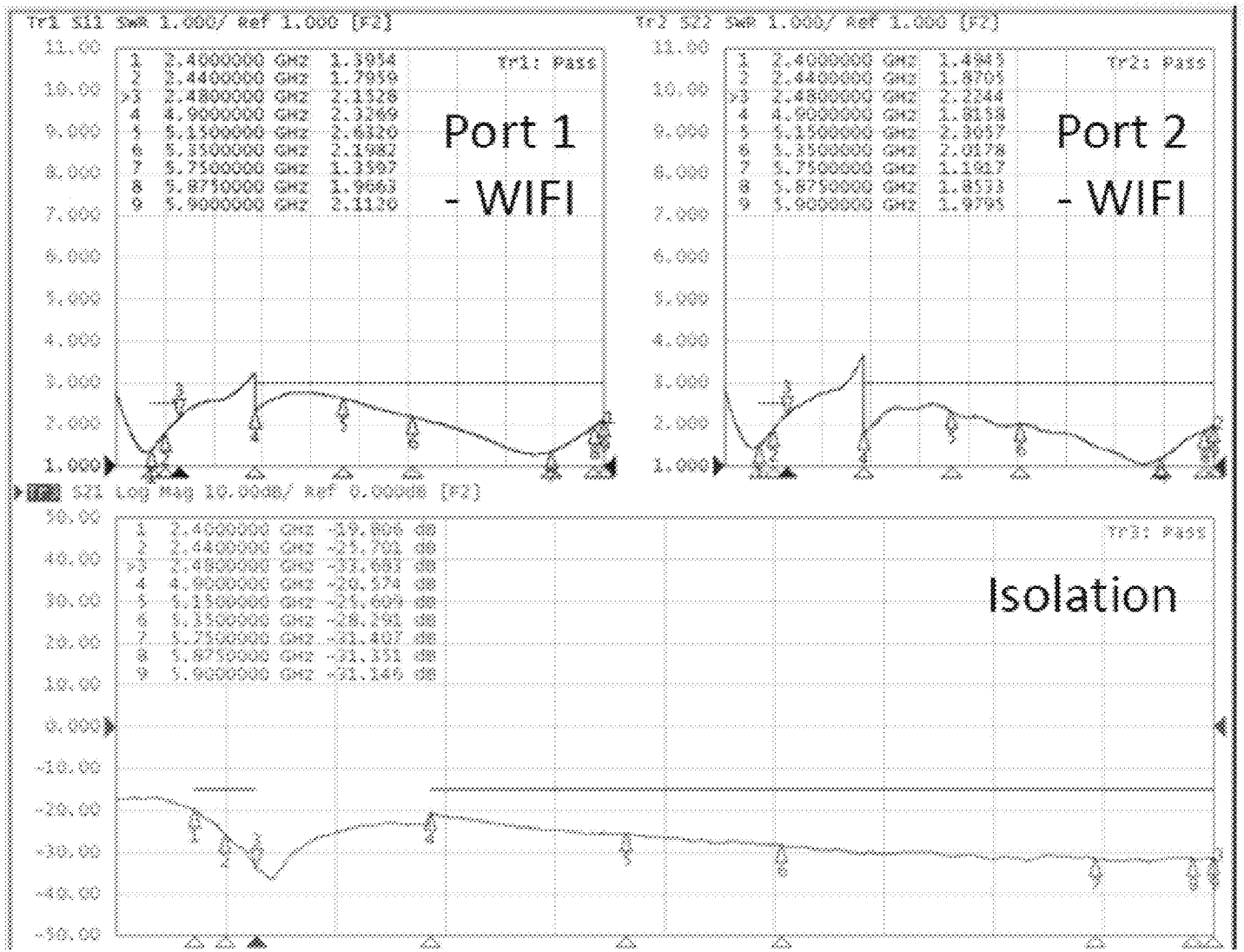
FIG. 3 illustrates exemplary line graphs of isolation and voltage standing wave ratio (VSWR) versus frequency in gigahertz (GHz) measured for each port of a prototype of the exemplary antenna of FIG. 1.

More specifically, FIG. 3 includes three exemplary line graphs illustrating isolation in decibels (dB), and VSWR, versus frequency in gigahertz (GHz) measured for each Port 1 and Port 2 of a prototype of the antenna 100 of FIGS. 1 and 2. Generally, FIG. 3 shows that the antenna 100 is operable with a good standing wave ratio for each port, and good isolation, in frequency bands from about 2.4 GHz to about 2.48 GHz and about 4.9 GHz to about 5.9 GHz.

Figure 4:
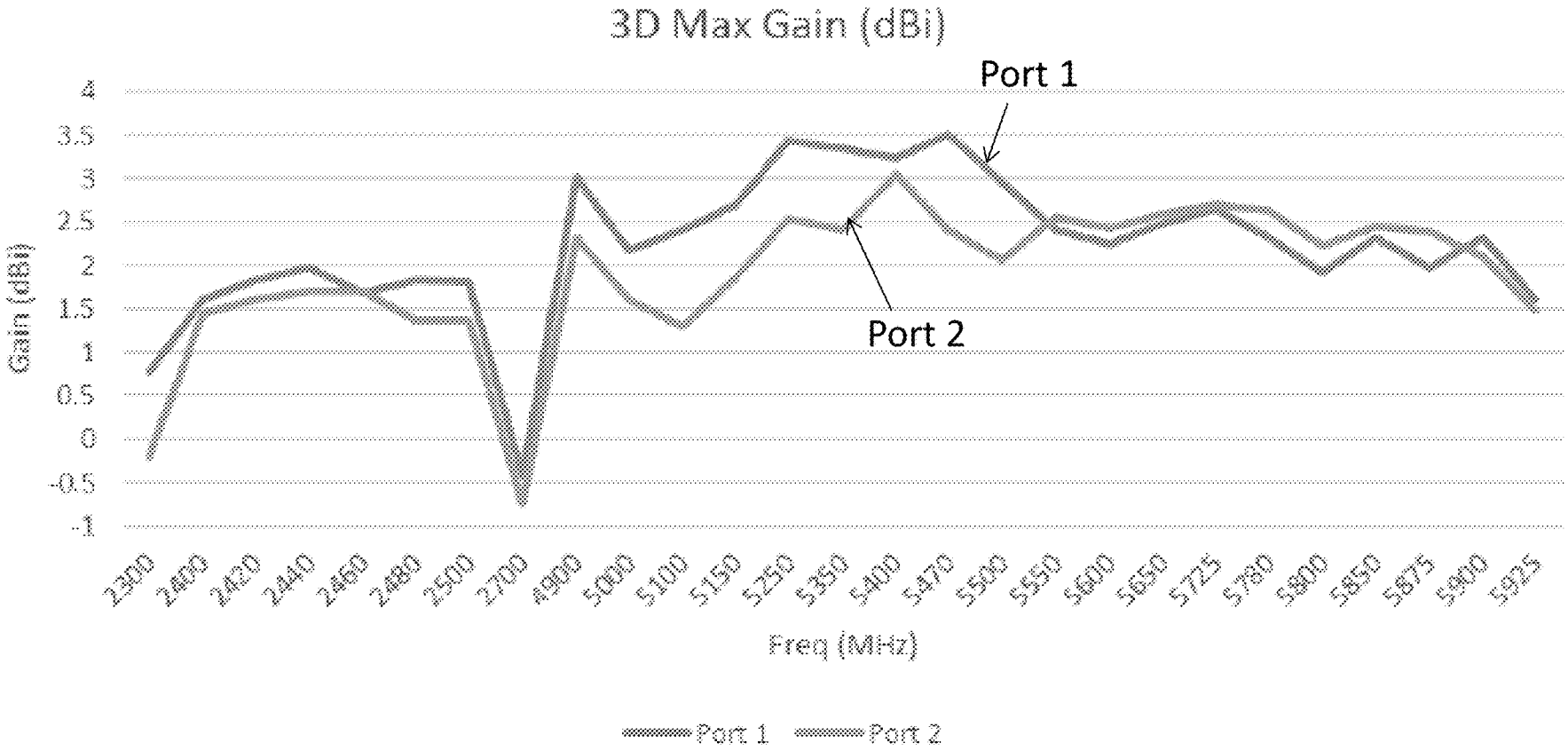
FIG. 4 is an exemplary line graph illustrating 3D maximum gain in decibels relative to isotropic (dBi) versus frequency in megahertz (MHz) measured for a prototype of the exemplary antenna of FIG. 1.
Figure 5:
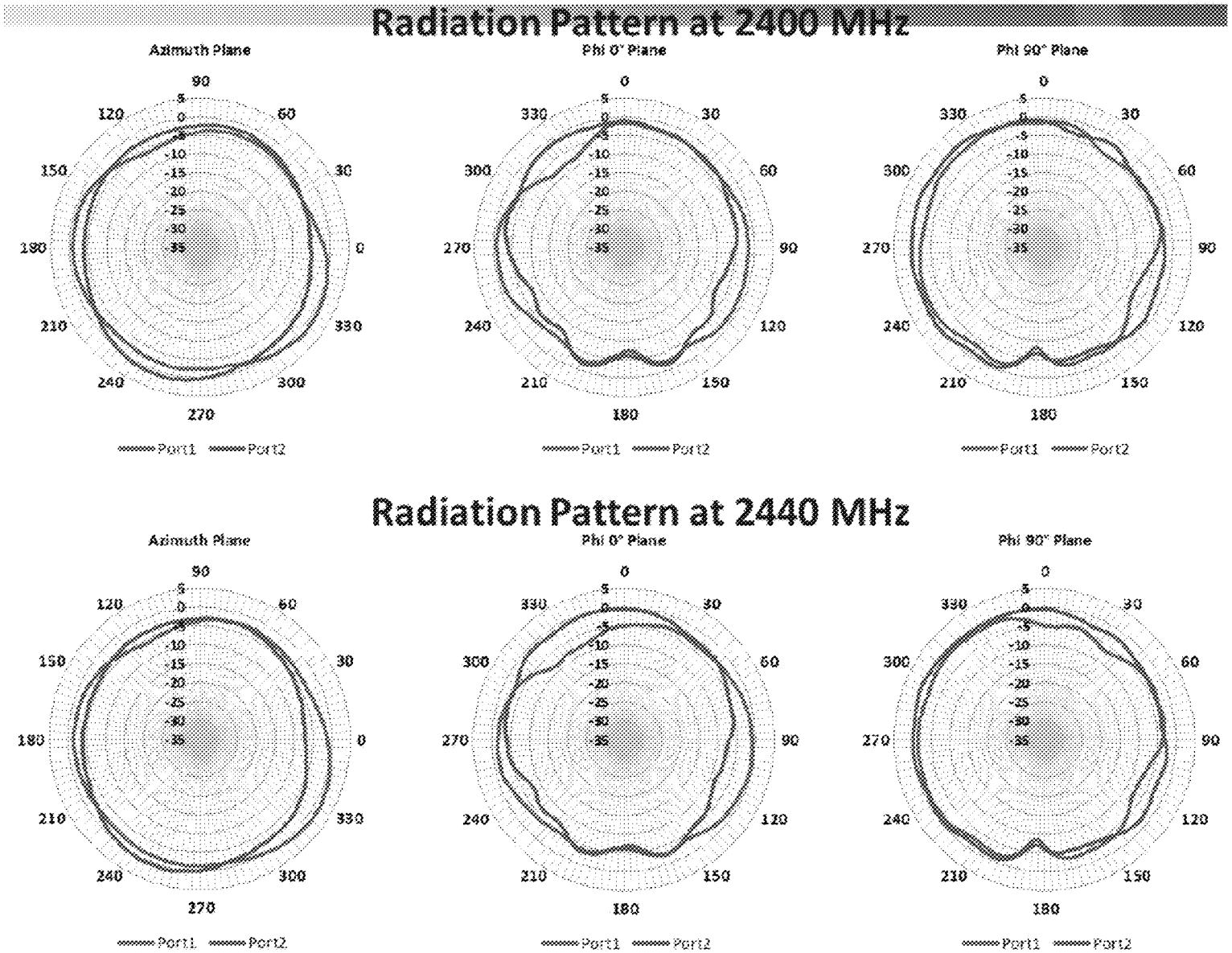
FIGS. 5-8 illustrate radiation patterns simulated for the exemplary antenna of FIG. 1 at frequencies of 2400 MHz, 2440 MHz, 2480 MHz, 4900 MHz, 5150 MHz, 5500 MHz, 5800 MHz, and 5900 MHz.
Figure 6:
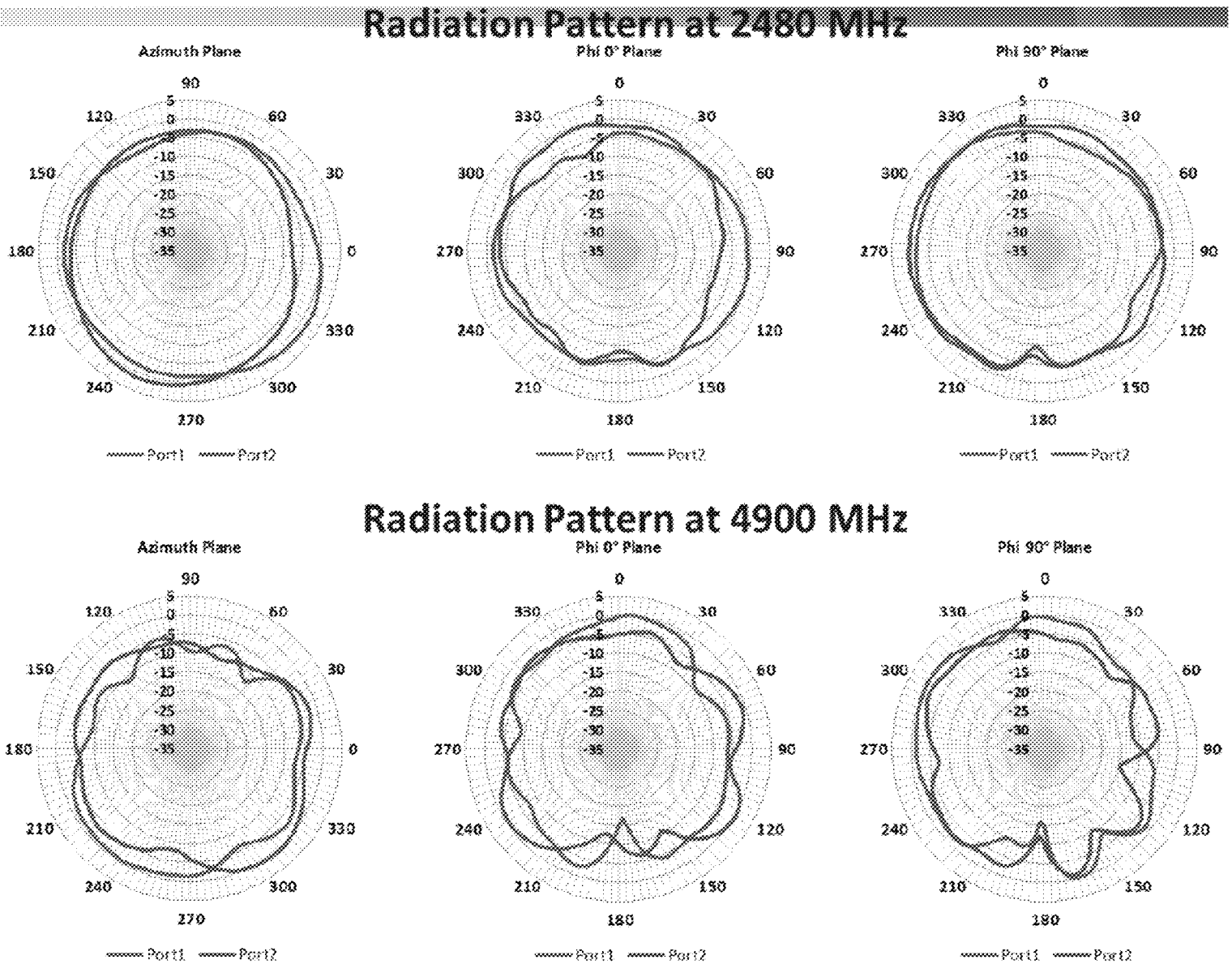
Figure 7:
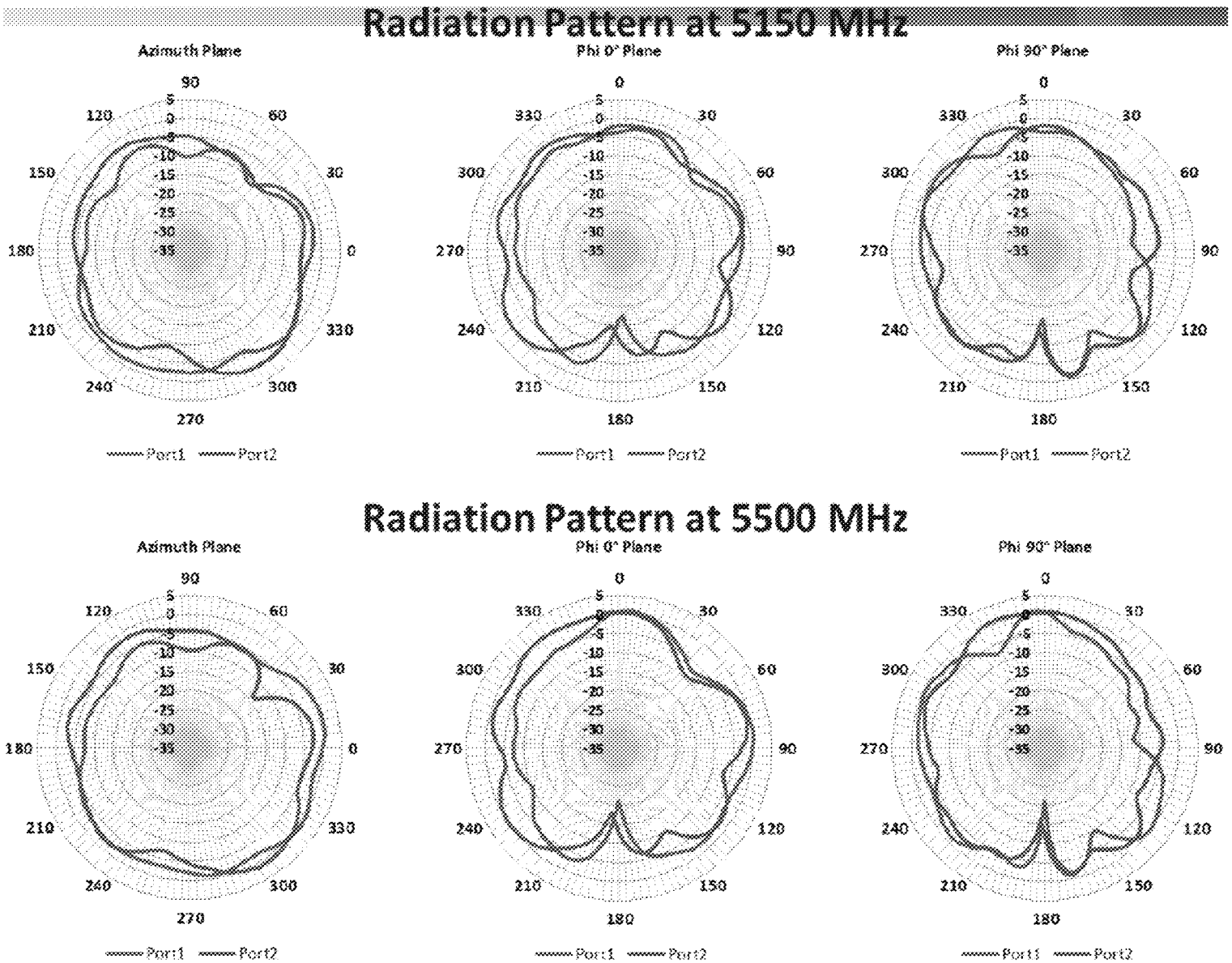
Figure 8:
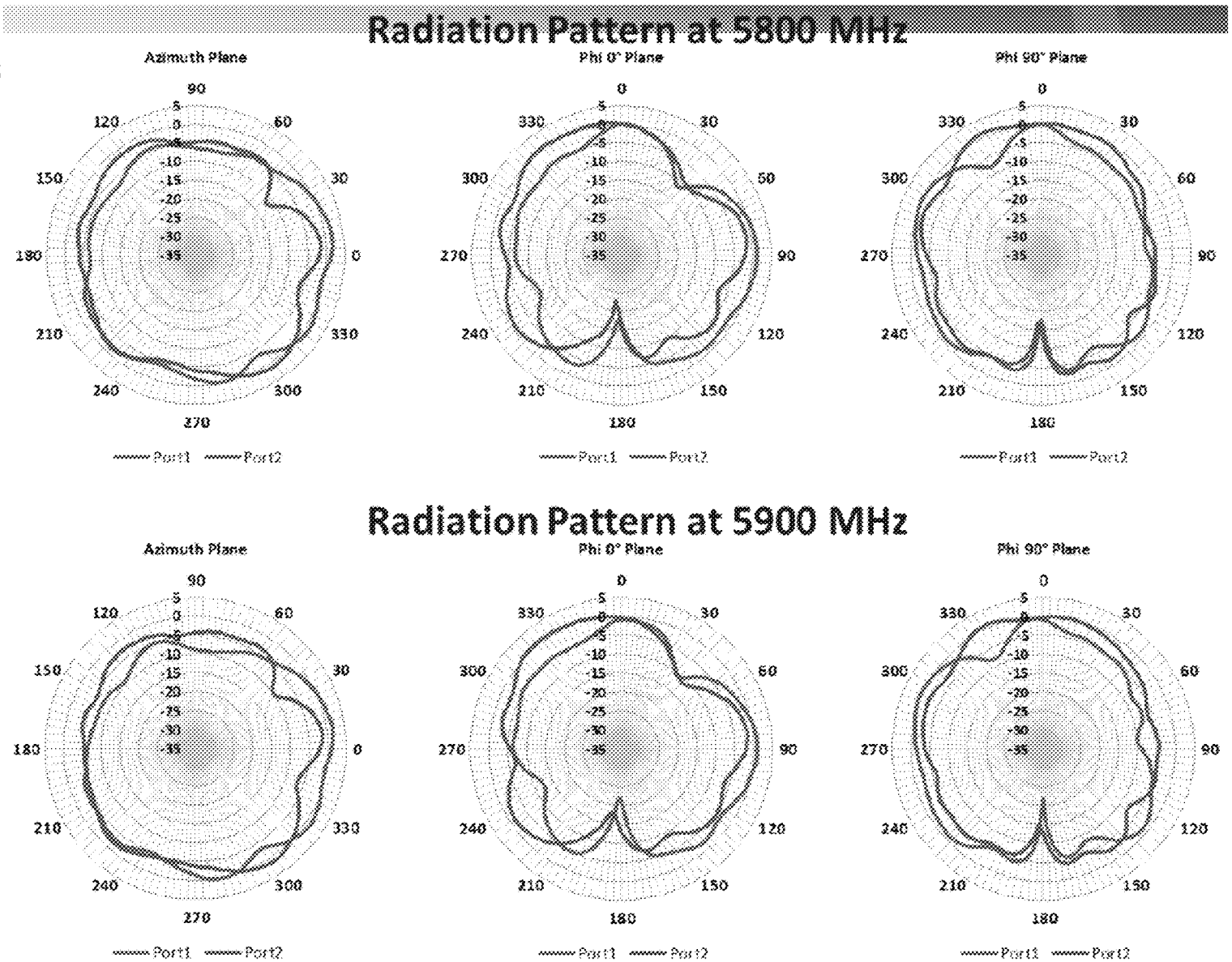

FIG. 4 is an exemplary line graph illustrating 3D maximum gain in decibels relative to isotropic (dBi) versus frequency in megahertz (MHz) measured for the prototype of the antenna 100. Generally, FIG. 4 shows that the antenna 100 is operable with good maximum gain in frequency bands from about 2400 MHz to about 2480 MHz and about 4900 MHz to about 5900 MHz.

FIGS. 5-8 illustrate various radiation patterns for the simulated design of the antenna 100. More specifically, FIGS. 5-8 illustrate far-field realized gain at Azimuth Plane (left), Phi=0° Plane (center), and Phi=90° Plane (right) at frequencies of 2400 MHz, 2440 MHz, 2480 MHz, 4900 MHz, 5150 MHz, 5500 MHz, 5800 MHz and 5900 MHz.

Figures 9A, 9B:
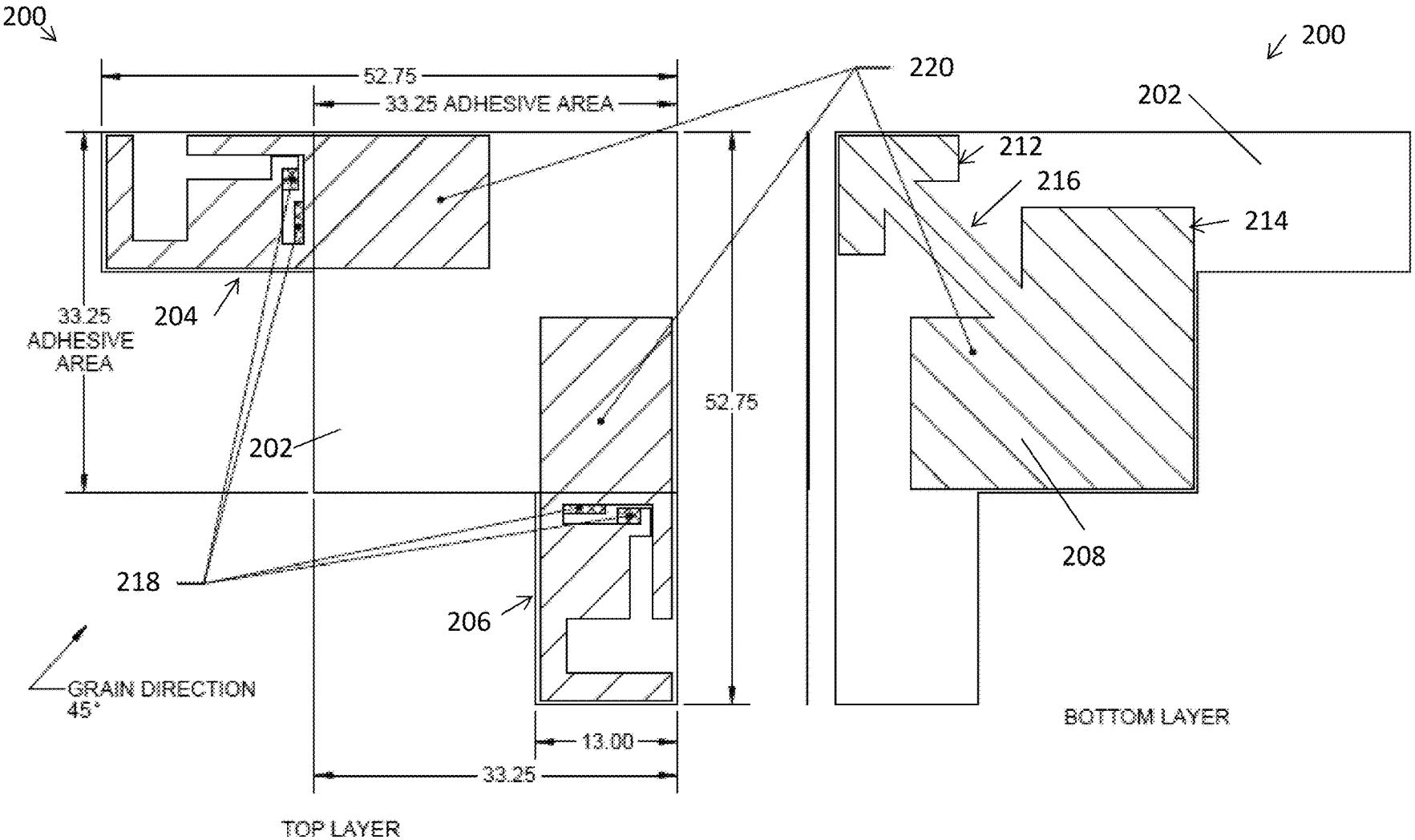
FIG. 9A is a top view of a flattened flexible PCB layout or pattern development of a dual-band multiple-input multiple-output (MIMO) antenna according to another exemplary embodiment.
FIG. 9B is a bottom view of the flattened flexible PCB layout or pattern development of a view of the MIMO antenna of FIG. 9A.

FIGS. 9A and 9B illustrate a flattened flexible PCB layout or pattern development of a dual-band multiple-input multiple-output (MIMO) antenna 200 according to another example embodiment of the present disclosure. The antenna 200 includes a circuit board 202, a first planar inverted-F antenna element 204 positioned on the circuit board 202, and a second planar inverted-F antenna element 206 positioned on the circuit board 202.

A ground element (e.g., layer, isolator, plane, etc.) 208 is also positioned on the circuit board 202. The ground element 208 includes a first arrow portion 212 and a second arrow portion 214. As shown in FIG. 9B, the second arrow portion 214 is larger than the first arrow portion 212.

The first arrow portion 212 is connected with the second arrow portion 214 via a middle portion 216 (e.g., linear connecting portion, etc.). In some cases, the first arrow portion 212 may correspond to a 5 GHz band, and the second arrow portion 214 may correspond to a 2.4 GHz band. For example, the ground element 208 may have a ¼ wavelength for 2.4 GHz and a ½ wavelength for 5 GHz. Although FIG. 9B illustrates a specific arrangement of the ground element 208, other embodiments may include ground elements with different shapes, arrangements, orientations, etc.

The circuit board 202 includes a top or upper layer (FIG. 9A) and a bottom or lower layer (FIG. 9B). As shown in FIG. 9A, the first planar inverted-F antenna element 204 and the second planar inverted-F antenna element 206 are located on the top layer of the circuit board 202. The ground element 208 is located on the bottom layer of the circuit board 202.

A portion of the first planar inverted-F antenna element 204 overlaps part of the second arrow portion 214 of the ground element 208 in a direction perpendicular to planes of the first planar inverted-F antenna element 204 and the ground element 208. Similarly, a portion of the second planar inverted-F antenna element 206 overlaps another part of the second arrow portion 214 of the ground element 208 in a direction perpendicular to planes of the second planar inverted-F antenna element 206 and the ground element 208.

Although FIGS. 9A and 9B illustrate a specific arrangement of the first and second planar inverted-F antenna elements 204 and 206 with respect to the position of the ground element 208, other embodiments may include antenna elements that overlap more or less (or none) of the ground element, antenna elements with a different position and/or orientation with respect to the ground element, etc.

As shown in FIG. 9A, the first planar inverted-F antenna element 204 element and the second planar inverted-F antenna element 206 are oriented at a ninety degree angle with respect to one another. This can improve antenna isolation and introduce different polarities for each antenna element 204 and 206 at each frequency band (e.g., a 2.4-2.48 GHz frequency band, a frequency 4.9-5.9 GHz frequency band, etc.).

Each planar inverted-F antenna element 204 and 206 may include any suitable PIFA element configuration. For example, each antenna element 204 and 206 may include a planar radiator or upper radiating patch element having a slot, a lower surface spaced apart from the planar radiator or upper radiating patch element, first and second shorting elements electrically connecting the planar radiator or upper radiating patch element to the lower surface, a feeding element electrically connected between the planar radiator or upper radiating patch element and the lower surface, etc. Each antenna element 204 and 206 can include one or more solder pads 218 for forming appropriate electrical connections.

The circuit board 202 may be a flexible printed circuit board (PCB). In some cases, the first planar inverted-F antenna element 204, the second planar inverted-F antenna element 206, and the ground element 208 each comprises one or more copper traces 220 on the flexible printed circuit board 202. In the example of FIGS. 9A and 9B, the copper traces 220 have a grain direction at approximately a forty-five degree angle.

In some embodiments, an adhesive layer may be positioned on a side of the circuit board 202. The adhesive layer can be used to mount the antenna 200 to a surface, which can reduce complexity when mounting the antenna 200, etc. Example dimensions in millimeters (mm) are provided in FIGS. 9A and 9B for purposes of illustration only, and other embodiments may include components with smaller and/or larger dimensions.

Figure 10:
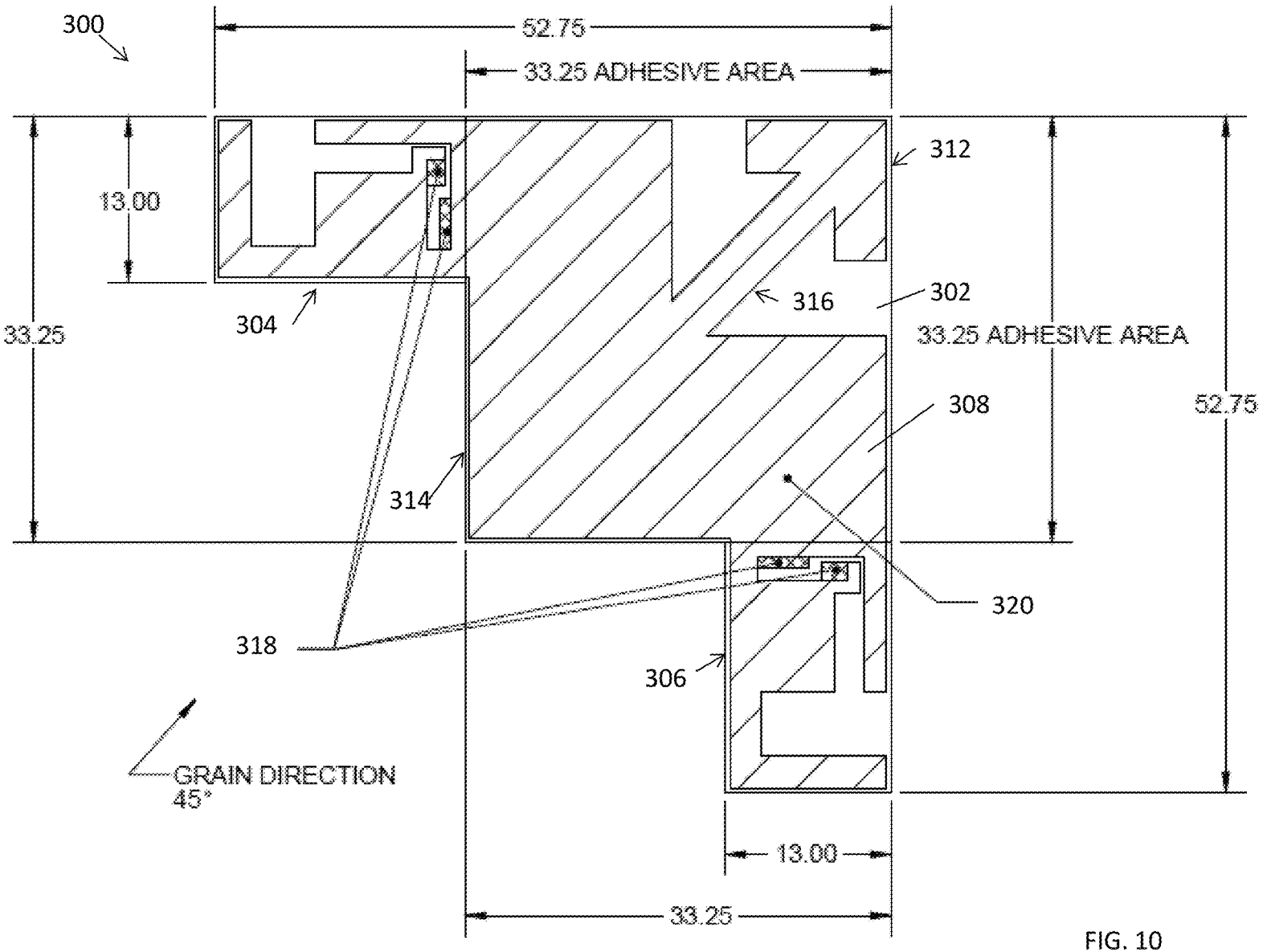
FIG. 10 is a top view of a flattened flexible PCB layout or pattern development of a dual-band multiple-input multiple-output (MIMO) antenna according to yet another exemplary embodiment.

FIG. 10 illustrates a flattened flexible PCB or pattern development of a dual-band multiple-input multiple-output (MIMO) antenna 300 according to another example embodiment of the present disclosure. The antenna 300 includes a circuit board 302, a first planar inverted-F antenna element 304 positioned on the circuit board 302, and a second planar inverted-F antenna element 306 positioned on the circuit board 302.

A ground element (e.g., layer, isolator, plane, etc.) 308 is also positioned on the circuit board 302. The ground element 308 includes a first arrow portion 312 and a second arrow portion 314. As shown in FIG. 10, the second arrow portion 314 is larger than the first arrow portion 312.

The first arrow portion 312 is connected with the second arrow portion 314 via a middle portion 316. In some cases, the first arrow portion 312 may correspond to a 5 GHz band, and the second arrow portion 314 may correspond to a 2.4 GHz band. For example, the ground element 308 may have a ¼ wavelength for 2.4 GHz and a ½ wavelength for 5 GHz. Although FIG. 10 illustrates a specific arrangement of the ground element 308, other embodiments may include ground elements with different shapes, arrangements, orientations, dimensions, etc.

As shown in FIG. 10, the first planar inverted-F antenna element 304, the second planar inverted-F antenna element 306, and the ground element 308 are positioned on a same layer of the circuit board 302. In this arrangement, the ground element 308 is positioned between the first planar inverted-F antenna element 304 and the second planar inverted-F antenna element 306.

The circuit board 302 may be a flexible printed circuit board (PCB). In some cases, the first planar inverted-F antenna element 304, the second planar inverted-F antenna element 306 and the ground element 308 each comprises one or more copper traces 320 on the flexible printed circuit board 302. In the example of FIG. 10, the copper traces 320 have a grain direction at approximately a forty-five degree angle.

Each antenna element 304 and 306 can include one or more solder pads 318 for forming appropriate electrical connections. In some embodiments, an adhesive layer may be positioned on a side of the circuit board 302. The adhesive layer can be used to mount the antenna 300 to a surface, which can reduce complexity when mounting the antenna 300, etc. Example dimensions (in millimeters) are provided in FIG. 10 for purposes of illustration only, and other embodiments may include components with smaller and/or larger dimensions.

Figure 11A:
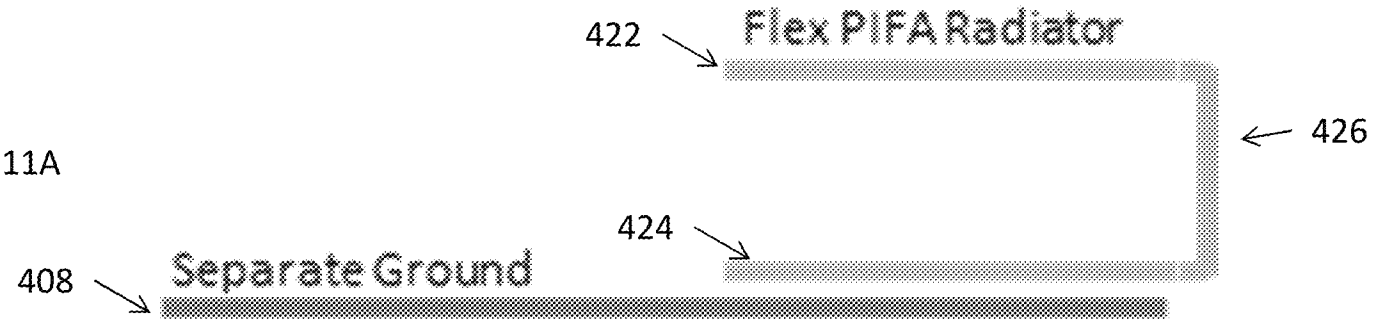
FIGS. 11A and 11B are side views of a ground element and a radiating element of the MIMO antennas of FIGS. 9A and 9B.
Figure 11B:
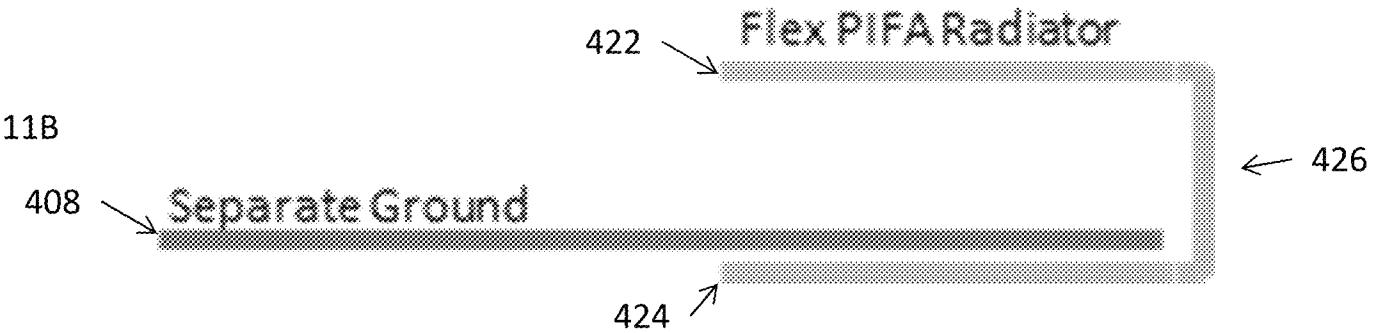
Figure 11C:
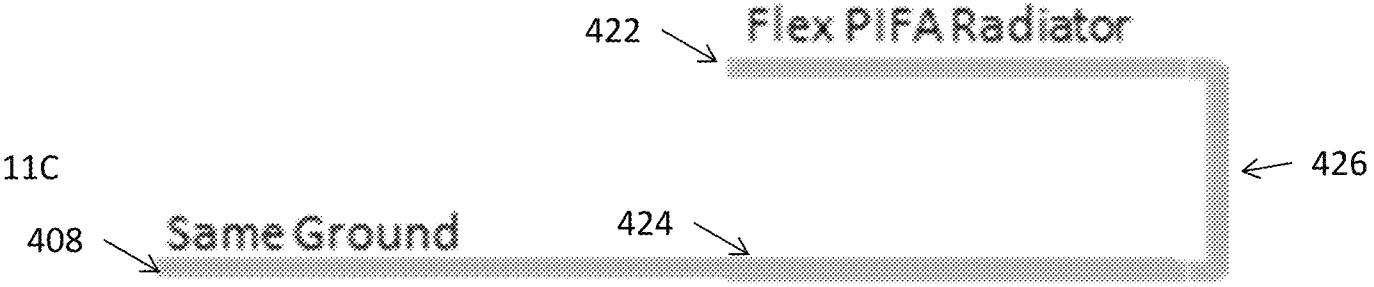
FIG. 11C is a side view of a ground element and radiating element of the MIMO antenna of FIG. 10.

As described above, each radiating element may include an upper planar radiator, and a lower surface electrically connected to the upper planar radiator. FIGS. 11A-11C illustrate optional placements of a ground element 408 with respect to the upper planar radiator 422 and the lower surface 424 of a radiating element 426.

As shown in FIG. 11A, the ground element 408 may be positioned below the lower surface 424 of the radiating element 426. Alternatively, as shown in FIG. 11B, the ground element 408 may be positioned above the lower surface 424 of the radiating element 426, but below the upper planar radiator 422. Therefore, the ground element 408 can be positioned between the upper planar radiator 422 and the lower surface 424. As another option, and as shown in FIG. 11C, the ground element 408 may be electrically connected to (e.g., integral with, etc.) the lower surface 424 of the radiating element 426, etc.

Figure 12:
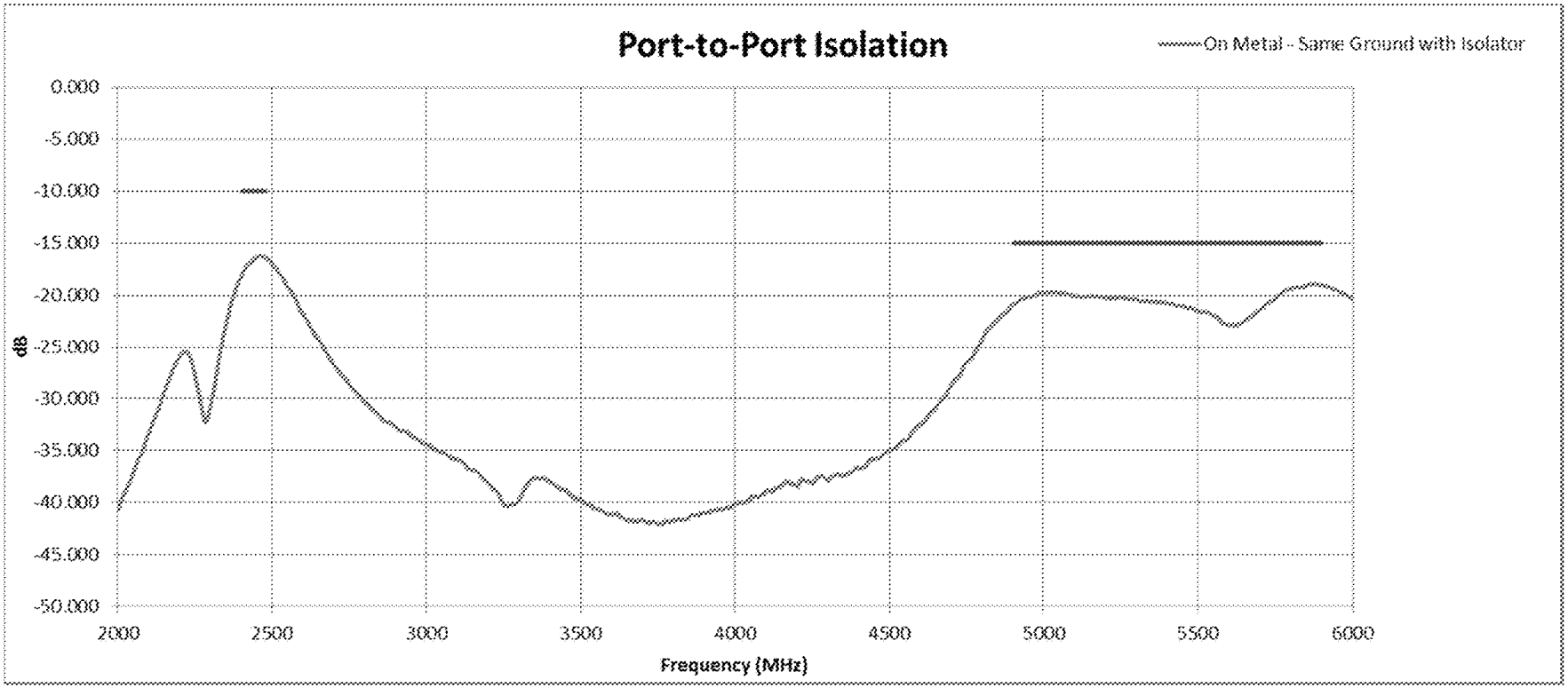
FIG. 12 is an exemplary line graph illustrating port to port isolation in decibels (dB) versus frequency in megahertz (MHz) measured for a prototype of the antenna of FIG. 9A.

FIG. 12 is an exemplary line graph illustrating port to port isolation in decibels (dB) versus frequency in megahertz (MHz) measured for a prototype of the antenna 300 positioned on a metal base. Generally, FIG. 12 shows that the antenna 300 is operable with good port to port isolation in frequency bands from about 2400 MHz to about 2480 MHz and from about 4900 MHz to about 5900 MHz.

FIGS. 13A-13C illustrates performance summary data measured for prototypes of the antennas 200 and 300 illustrated in FIGS. 9 and 10, on a plastic base and on a metal base. As shown in FIGS. 13A-13C, the antennas 200 and 300 have good isolation, peak gain, VSWR, etc. at desired operating frequencies.

Figure 14:
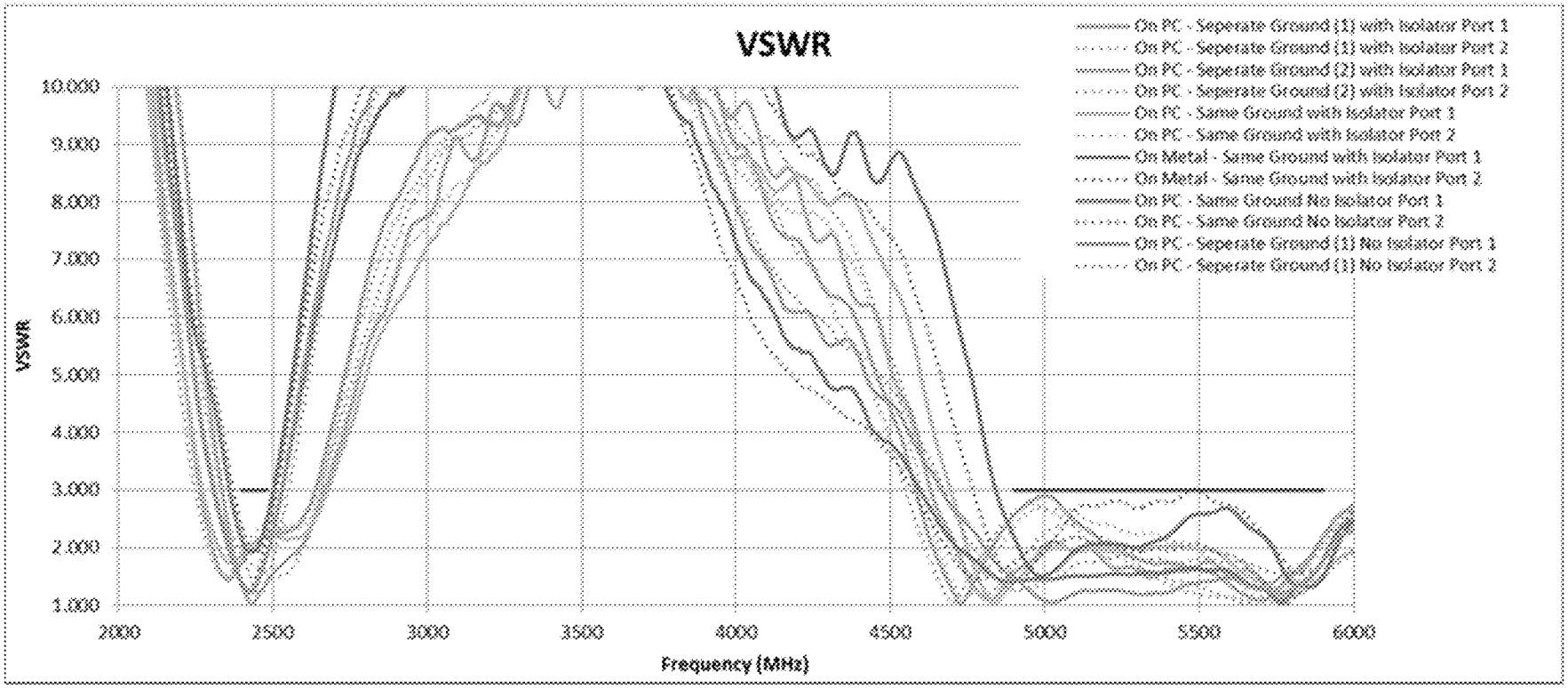
FIG. 14 is an exemplary line graph illustrating VSWR versus frequency in megahertz (MHz) measured for a prototype of the antennas of FIGS. 9A, 9B and 10 with different positions and types of ground elements.

FIG. 14 is an exemplary line graph illustrating VSWR versus frequency in megahertz (MHz) measured for a prototype of the antenna 200 and/or 300. Generally, FIG. 14 shows that the antenna 200 and/or 300 has a low VSWR in frequency bands from about 2400 MHz to about 2480 MHz and from about 4900 MHz to about 5900 MHz.

Figure 15:
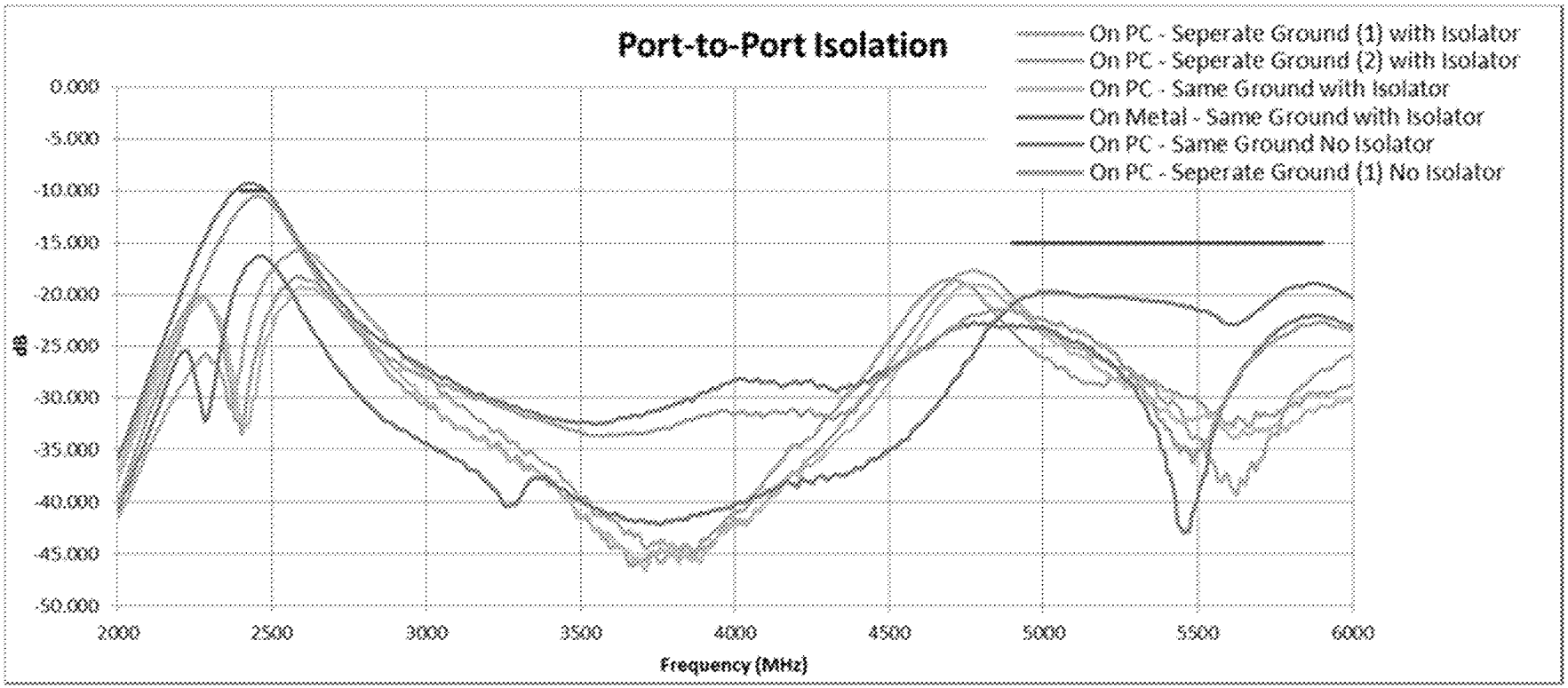
FIG. 15 is an exemplary line graph illustrating port to port isolation in decibels versus frequency in megahertz (MHz) measured for a prototype of the antennas of FIGS. 9A, 9B and 10 with different positions and types of ground elements.

FIG. 15 is an exemplary line graph illustrating port to port isolation in decibels (dB) versus frequency in megahertz (MHz) measured for a prototype of the antenna 200 and/or 300. Generally, FIG. 15 shows that the antenna 200 and/or 300 is operable with good port to port isolation in frequency bands from about 2400 MHz to about 2480 MHz and from about 4900 MHz to about 5900 MHz.

Figure 16:
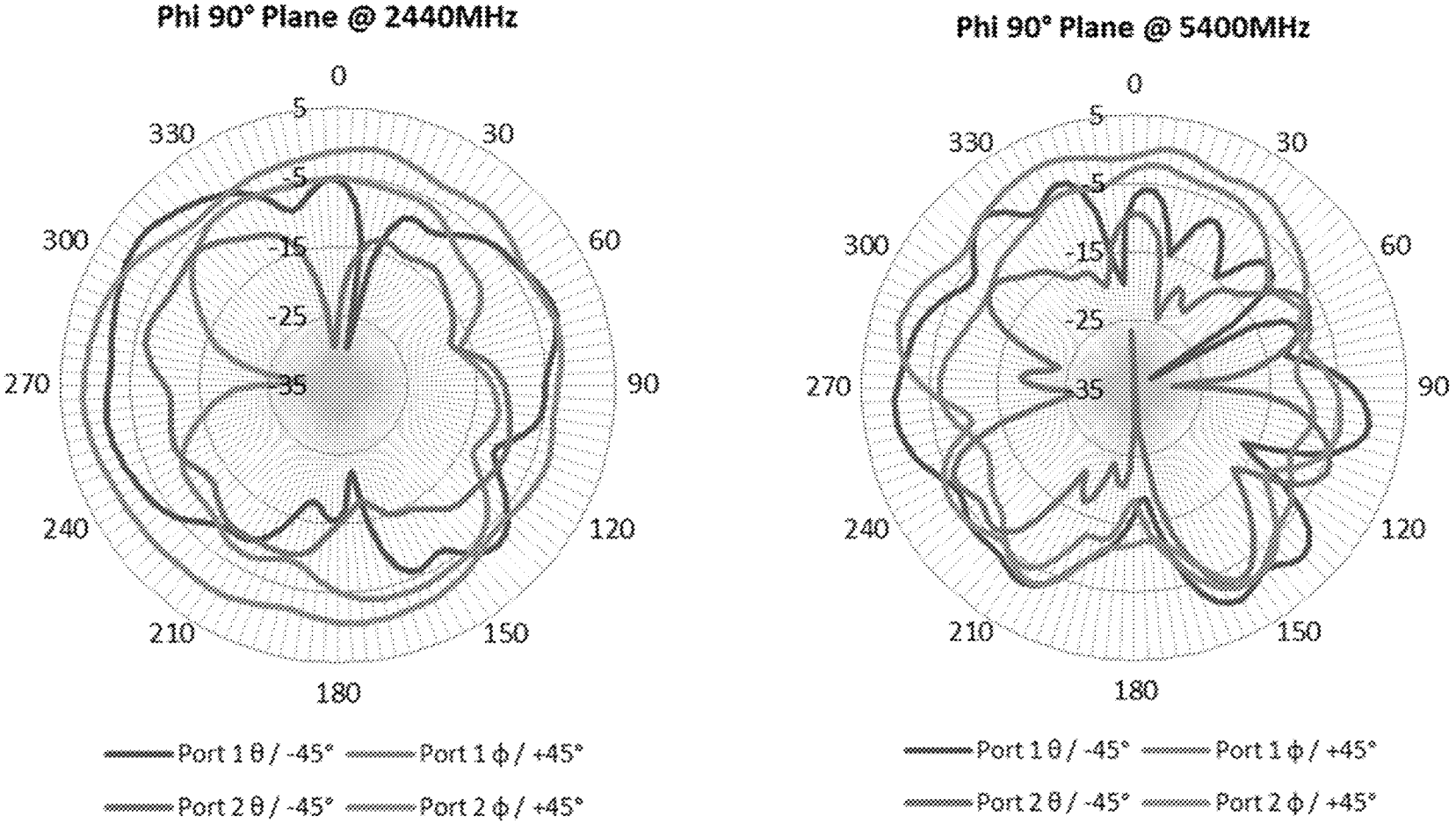
FIG. 16 illustrates various polarizations of radiation patterns for the simulated design of the antenna of FIG. 9A at frequencies of 2440 MHz and 5400.

FIG. 16 illustrates various polarizations of radiation patterns for the simulated design of the antenna 200. More specifically, FIG. 16 illustrates far-field realized gain at Phi=90° Plane at frequencies of 2440 MHz and 5400 MHz.

Figure 17:
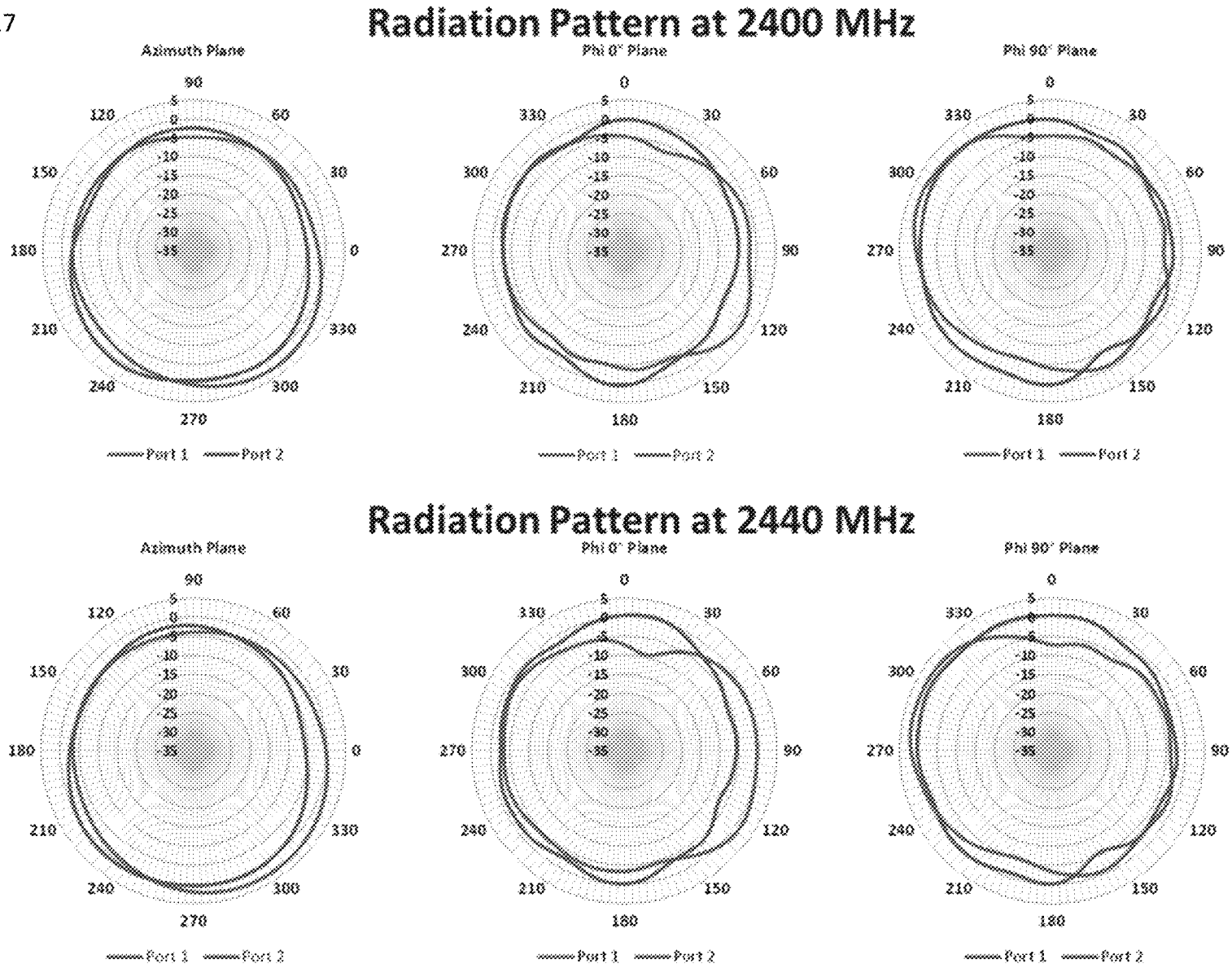
FIG. 17-19 illustrate various radiation patterns for the simulated design of the antenna of FIG. 9A at frequencies of 2400 MHz, 2440 MHz, 2480 MHz, 4900 MHz, 5400 MHz, and 5900 MHz.
Figure 18:
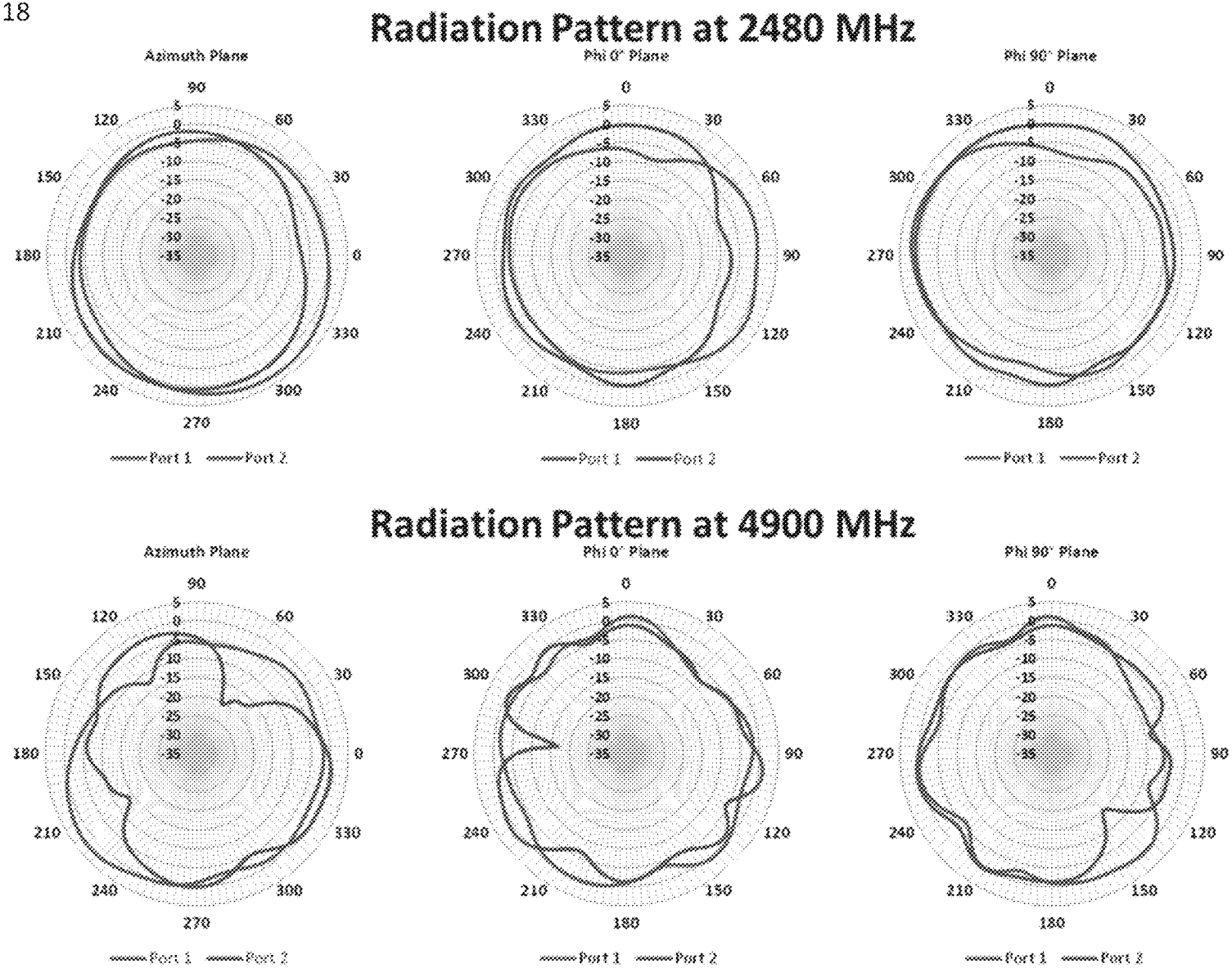
Figure 19:
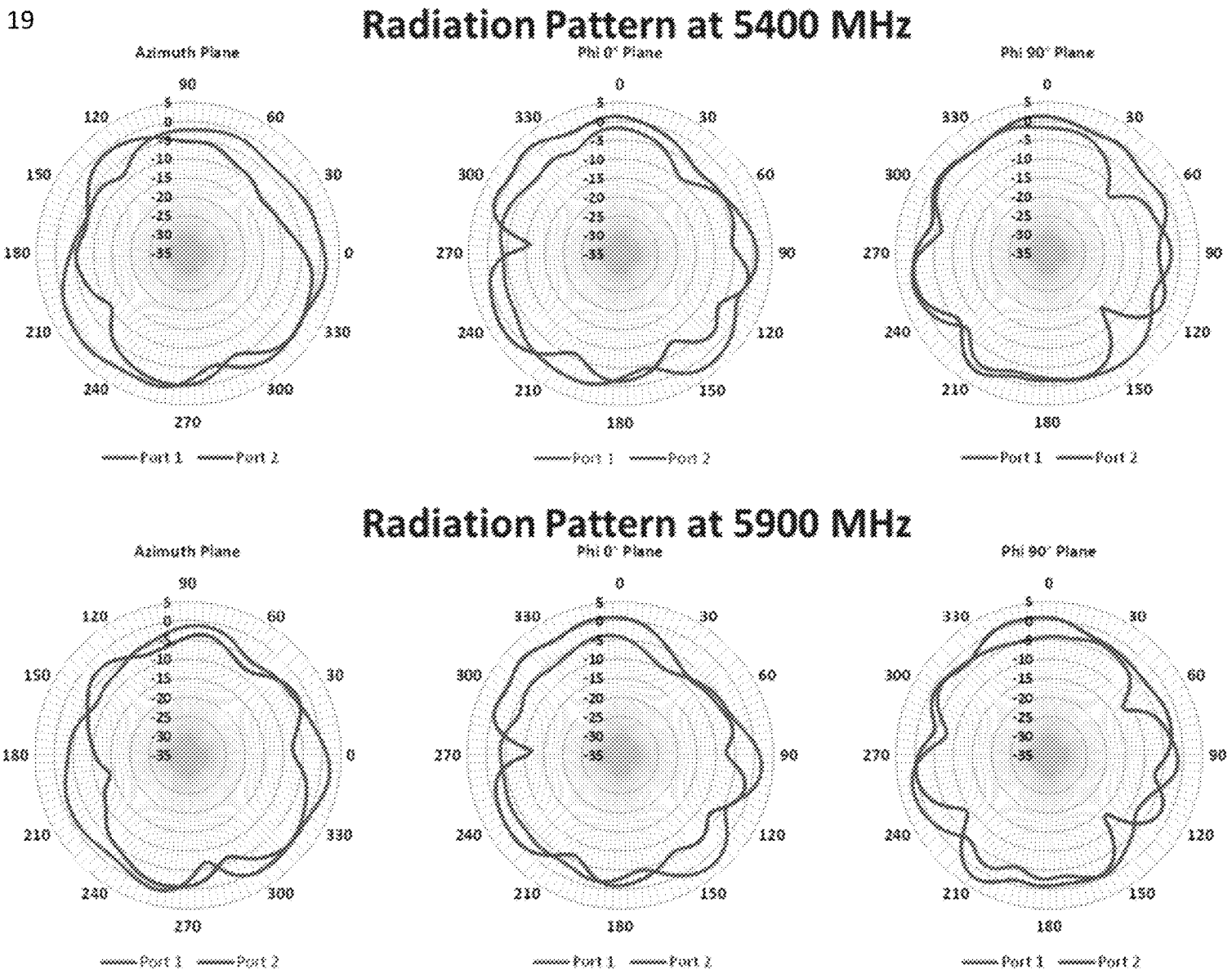

FIG. 17-19 illustrate various radiation patterns for the simulated design of the antenna 200. More specifically, FIG. 17-19 illustrate farfield realized gain at Azimuth Plane (left), Phi=0° Plane (center), and Phi=90° Plane (right) at frequencies of 2400 MHz, 2440 MHz, 2480 MHz, 4900 MHz, 5400 MHz, and 5900 MHz.

The antennas disclosed herein including the antennas, the ground elements, antenna elements, etc., may be any suitable size (e.g., height, diameter, width, length, etc.). The size of each component of an antenna may be determined based on particular specifications, desired results, etc.

Exemplary embodiments of the antenna systems disclosed herein may be suitable for a wide range of applications, e.g., that use more than one antenna, such as LTE/4G applications and/or infrastructure antenna systems (e.g., customer premises equipment (CPE), terminal stations, central stations, in-building antenna systems, etc.). An antenna disclosed herein may be configured for use as an omnidirectional MIMO antenna, although aspects of the present disclosure are not limited solely to omnidirectional and/or MIMO antennas. An antenna disclosed herein may be implemented inside an electronic device, such as machine to machine, vehicular, in-building unit, etc. In which case, the internal antenna components would typically be internal to and covered by the electronic device housing. As another example, the antenna may instead be housed within a radome, which may have a low profile. In this latter case, the internal antenna components would be housed within and covered by the radome. Accordingly, the antennas disclosed herein should not be limited to any one particular end use.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific numerical dimensions and values, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A dual-band multiple-input multiple-output (MIMO) antenna comprising:

a flexible printed circuit board (PCB) including first and second antenna radiating elements at opposite corners of the flexible printed circuit board that are diagonally across from one another, and defining a single structure having a flattened flexible PCB layout or pattern development; and at least two antenna feeding elements extending from the first and second antenna radiating elements, wherein:

each of the at least two antenna feeding elements is electrically connected with a different one of the first and second antenna elements; and each of the at least two antenna feeding elements extends beyond an edge of the flexible printed circuit board at an orientation of ninety degrees with respect to one another; and wherein the flexible printed circuit board comprises a ground element including a first portion, a middle portion, and a second portion, wherein the first portion and the second portion are positioned at other opposite corners of the flexible printed circuit board that are diagonally across from one another, and wherein the middle portion connects the first portion and the second portion.

2. The antenna of claim 1, wherein the single structure having the flattened flexible PCB layout or pattern development defined by the flexible printed circuit board including the first and second antenna radiating elements is foldable into a three-dimensional dual-band antenna array assembly.

3. The antenna of claim 1, wherein the first antenna radiating element and the second antenna radiating element are each oriented at a ninety degree angle with respect to one another.

4. The antenna of claim 1, wherein the first antenna radiating element and the second antenna radiating element comprise identical dual band planar inverted-F antenna elements.

5. The antenna of claim 1, wherein the flexible printed circuit board including the first and second antenna radiating elements is folded into a three-dimensional dual-band antenna array assembly.

6. The antenna of claim 1, further comprising an adhesive layer positioned on at least one side of the flexible printed circuit board for mounting the antenna to a surface.

7. The antenna of claim 1, wherein:

the first and second portions of the ground element comprise first and second arrow portions, respectively;

the second arrow portion is larger than the first arrow portion;

the first arrow portion and the second arrow portion are positioned at the other opposite corners of the flexible printed circuit board that are diagonally across from one another; and the middle portion linearly connects the first arrow portion and the second arrow portion along a line that bisects the first arrow portion and the second arrow portion.

8. The antenna of claim 1, wherein:

each of the first and second antenna radiating elements is configured to operate in at least a first frequency range of about 2.4 GHz to 2.48 GHz; and each of the first and second antenna radiating elements is configured to operate in at least a second frequency range of about 4.9 GHz to 5.9 GHz.

9. An antenna comprising:

a circuit board;

a first planar inverted-F antenna element positioned on the circuit board;

a second planar inverted-F antenna element positioned on the circuit board; and a ground element positioned on the circuit board, the ground element including a first arrow portion, a middle portion, and a second arrow portion, wherein:

the second arrow portion is larger than the first arrow portion;

the first arrow portion and the second arrow portion are positioned at opposite corners of the circuit board that are diagonally across from one another; and the middle portion linearly connects the first arrow portion and the second arrow portion along a line that bisects the first arrow portion and the second arrow portion.

10. The antenna of claim 9, wherein:

the circuit board includes at least two layers;

the first planar inverted-F antenna element and the second planar inverted-F antenna element are located on a first one of the at least two layers; and the ground element is located on a second one of the at least two layers, said second layer different from the first layer.

11. The antenna of claim 10, wherein:

at least a portion of the first planar inverted-F antenna element overlaps at least a portion of the ground element in a direction perpendicular to planes of the first planar inverted-F antenna element and the ground layer; and at least a portion of the second planar inverted-F antenna element overlaps at least another portion of the ground element in a direction perpendicular to planes of the second planar inverted-F antenna element and the ground layer.

12. The antenna of claim 11, wherein the portions of the first planar inverted-F antenna element and the second planar inverted-F antenna element overlap at least part of the second arrow portion of the ground element.

13. The antenna of claim 9, wherein the first planar inverted-F antenna element, the second planar inverted-F antenna element, and the ground element are positioned on a same layer of the circuit board.

14. The antenna of claim 13, wherein the ground element is positioned between the first planar inverted-F antenna element and the second planar inverted-F antenna element.

15. The antenna of claim 9, wherein the first planar inverted-F antenna element and the second planar inverted-F antenna element are oriented at a ninety degree angle with respect to one another.

16. The antenna of claim 9, wherein the first planar inverted-F antenna element, the second planar inverted-F antenna element and the ground element are positioned to create an isolation value of at least fifteen decibels (dB).

17. The antenna of claim 9, wherein the first planar inverted-F antenna element, the second planar inverted-F antenna element, and the ground element each comprise one or more copper traces of a flexible printed circuit board.

18. The antenna of claim 9, wherein:

the antenna comprises a dual-band multiple-input multiple-output (MIMO) antenna;

each of the first and second planar inverted-F antenna elements is configured to operate in at least a frequency range of about 2.4 GHz to 2.48 GHz; and each of the first and second planar inverted-F antenna elements is configured to operate in at least a frequency range of about 4.9 GHz to 5.9 GHz.

* * * * *